US007552518B2

(12) United States Patent
Webber et al.

(10) Patent No.: US 7,552,518 B2
(45) Date of Patent: Jun. 30, 2009

(54) SEAT BELT BUCKLE FOR USE WITH PRETENSIONER

(75) Inventors: James L. Webber, Shelby Township, MI (US); David G. Hlavaty, Northville, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/838,560

(22) Filed: Aug. 14, 2007

(65) Prior Publication Data

US 2008/0040905 A1 Feb. 21, 2008

Related U.S. Application Data

(63) Continuation-in-part of application No. 11/435,543, filed on May 17, 2006.

(60) Provisional application No. 60/837,949, filed on Aug. 15, 2006.

(51) Int. Cl.
*A44B 11/25* (2006.01)

(52) U.S. Cl. ..... 24/641; 24/633

(58) Field of Classification Search ..... 24/629, 24/633–650; 280/801.1, 806, 808
See application file for complete search history.

(56) References Cited

U.S. PATENT DOCUMENTS 5,159,732 A * 11/1992 Burke ..... 24/641
5,213,365 A * 5/1993 Fohl ..... 24/642
5,522,619 A * 6/1996 Collins ..... 24/641
5,595,400 A * 1/1997 Wier ..... 24/642
6,233,794 B1 * 5/2001 Kohlndorfer et al. ..... 24/641
6,438,810 B2 * 8/2002 Rogers et al. ..... 24/641
6,550,112 B2 * 4/2003 Rohrle et al. ..... 24/641
6,588,077 B2 * 7/2003 Katsuyama et al. ..... 24/641
7,124,480 B2 * 10/2006 Kawai et al. ..... 24/641
7,370,393 B2 * 5/2008 Hlavaty et al. ..... 24/633

* cited by examiner

*Primary Examiner*—Robert J Sandy
*Assistant Examiner*—Ruth C Rodriguez
(74) *Attorney, Agent, or Firm*—Douglas D. Fekete

(57) ABSTRACT

A seat belt buckle, comprising: a frame portion; a release button slidably mounted to the frame portion for movement between a first position and a second position; an inertia locking device rotatably mounted to the frame portion for movement between a blocking position and an unblocking position, the inertia locking device being configured to make contact with a cam surface of the release button when the inertia locking device is in the blocking position and slidable movement of the release button with respect to the frame portion is prevented when the inertia locking device is in the blocking position and the inertia locking device contacts the cam surface of the release button; and a biasing member for providing a biasing force for biasing the inertia locking device into the unblocking position, the inertia locking device being rotated into the blocking position when the biasing force of the biasing member is overcome.

17 Claims, 17 Drawing Sheets

SEAT BELT BUCKLE FOR USE WITH PRETENSIONER

CROSS REFERENCE TO RELATED APPLICATIONS

This application is a continuation in part of U.S. patent application Ser. No. 11/435,543, filed May 17, 2006, the contents of which are incorporated herein by reference thereto.

This application also claims the benefit of U.S. Provisional Patent Application Ser. No. 60/837,949, filed Aug. 15, 2006, the contents of which are incorporated herein by reference thereto.

BACKGROUND

Exemplary embodiments of the present invention relate generally to a seat belt buckle and more specifically, the present invention relates to a seat belt buckle for use with a seat belt pretensioner.

Seat belt buckles in general must meet many requirements to reliably operate under any and all conditions. One specific requirement for seat belt buckles is to function when used with seat belt pretensioners (i.e., retractor, buckle or anchor pretensioners).

Seat belt pretensioners remove seat belt slack in the event of a predetermined occurrence, when the pretensioners are activated a very high acceleration results in the webbing of the seat belt and subsequently, the seat belt buckle. An example of a pretensioner is a pyrotechnically actuatable device, which fires a squib wherein a resulting force will remove a predetermined amount of slack from the seat belt webbing secured to the seat belt buckle. Accordingly, and when pretensioners are activated, the seat belt buckle is subjected to a very high acceleration.

Therefore, it is desirable to provide the seat belt buckle with a locking feature or device that is engaged during activation of the pretensioners so that movement of the release button is limited. Additionally, it is desirable to provide a seat belt buckle with an inertia locking device to maintain a latched condition during activation of the pretensioners.

SUMMARY

In accordance with an exemplary embodiment of the present invention a seat belt buckle is provided the seat belt buckle comprising: a frame portion; a release button slidably mounted to the frame portion for movement between a first position and a second position; an inertia locking device rotatably mounted to the frame portion for movement between a blocking position and an unblocking position, the inertia locking device being configured to make contact with a cam surface of the release button when the inertia locking device is in the blocking position and slidable movement of the release button with respect to the frame portion is prevented when the inertia locking device is in the blocking position and the inertia locking device contacts the cam surface of the release button; and a biasing member for providing a biasing force for biasing the inertia locking device into the unblocking position, the inertia locking device being rotated into the blocking position when the biasing force of the biasing member is overcome.

In another exemplary embodiment, a seat belt buckle for use with a tongue of a seat belt is provided, the seat belt buckle comprising: a frame portion; a latch being movably mounted to the frame portion for movement between a latched position and an unlatched position, the latch being configured to engage a portion of the tongue inserted into the frame as the latch moves from the latched position to the unlatched position; an ejector being slidably mounted to the frame portion for movement between a locking position and a release position and movement of the ejector towards the release position causes an opening force to be applied to the latch in order to move the latch from the unlatched position towards the latched position and movement of the ejector towards the release position is caused by movement of a release button slidably mounted to the frame portion for movement between a first position and a second position; an inertia locking device rotatably mounted to the frame portion about a pivot axis for movement between a blocking position and an unblocking position, the inertia locking device being configured for rotation in a plane substantially parallel to a plane of movement of the latch and a center of gravity of the inertia locking device is aligned with the pivot axis of the inertia locking device, the inertia locking device being configured to make contact with a cam surface of the release button when the inertia locking device is in the blocking position and slidable movement of the release button with respect to the frame portion is prevented when the inertia locking device is in the blocking position and the inertia locking device contacts the cam surface of the release button; and a biasing member integrally formed with the release button, the biasing member providing a biasing force for biasing the inertia locking device into the unblocking position, the inertia locking device being rotated into the blocking position when biasing force of the biasing member is overcome.

In accordance with another exemplary embodiment a method for limiting movement of a release button of a seat belt buckle when an acceleration force is applied to the seat belt buckle is provided. The method comprising: rotatably mounting a mass to a frame portion of the seat belt buckle for movement between a blocking position and an unblocking position, the mass being configured to make contact with a cam surface of the release button when the mass is in the blocking position and slidable movement of the release button with respect to the frame portion is prevented when the mass is in the blocking position and the mass contacts the cam surface of the release button; and biasing the mass into the unblocking position by a biasing member integrally formed with the release button, the biasing member providing a biasing force for biasing the mass into the unblocking position and the inertia locking device is rotated into the blocking position when the biasing force of the biasing member is overcome.

The above-description and other features of the present disclosure will be appreciated and understood by those skilled in the art from the following detailed description, drawings, and appended claims.

DRAWINGS

Figure 5:
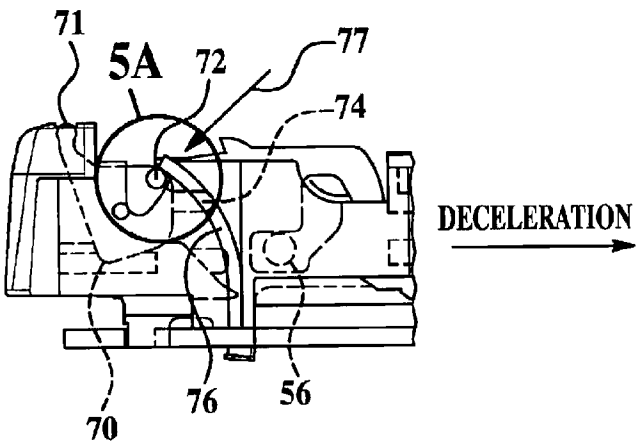
Figure 5B:
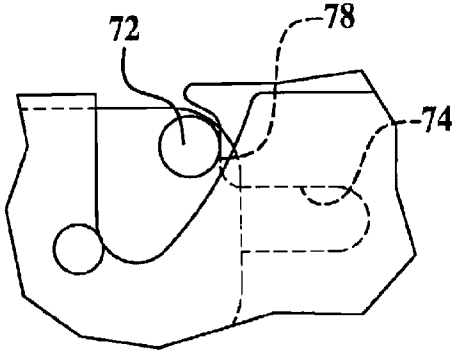
Figure 5A:
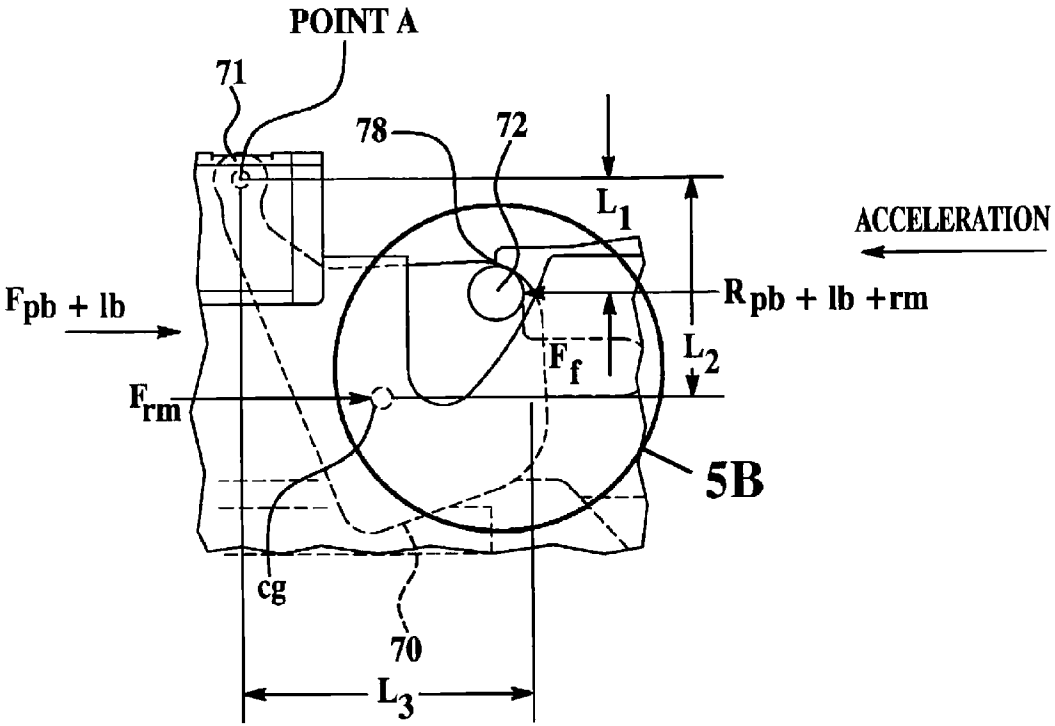
Figure 6:
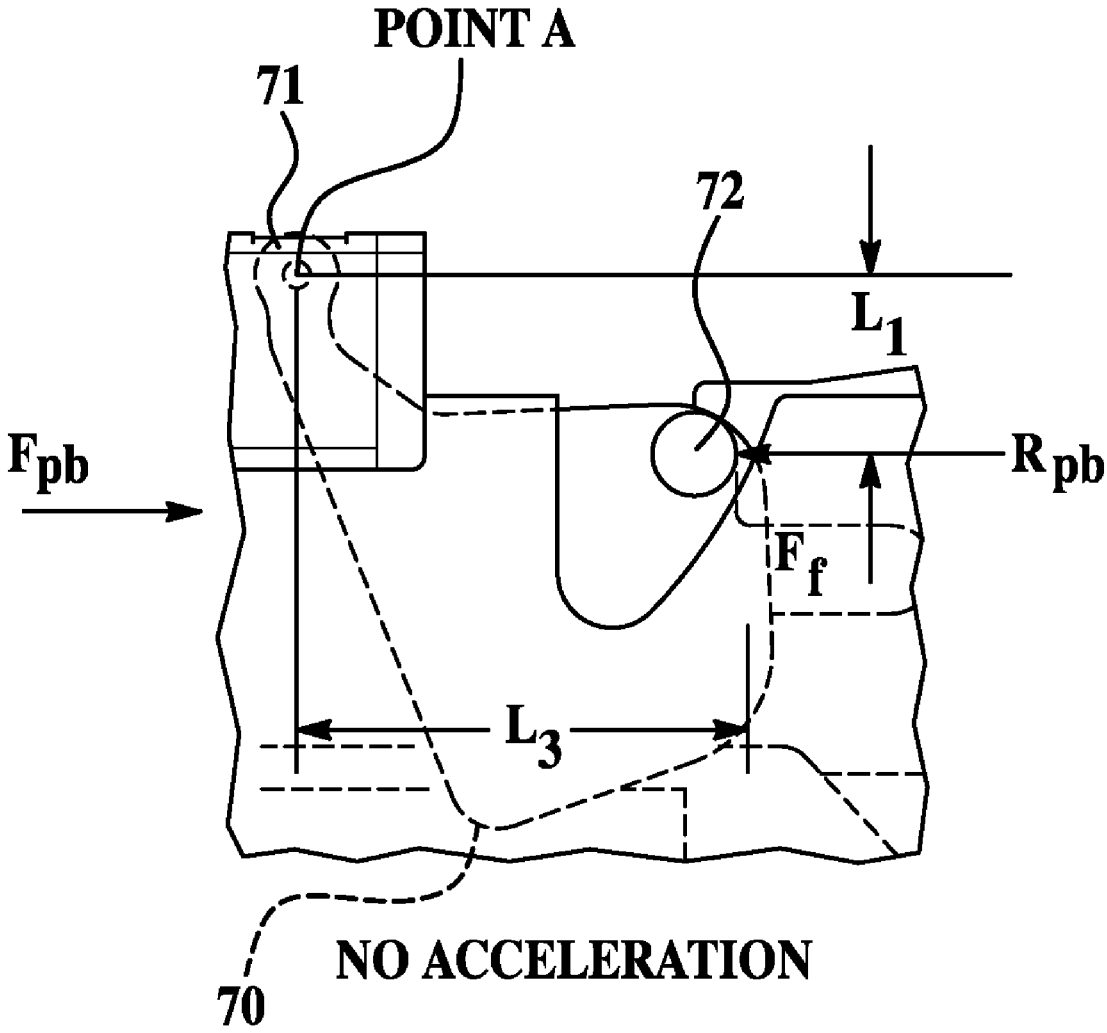
Figure 7:
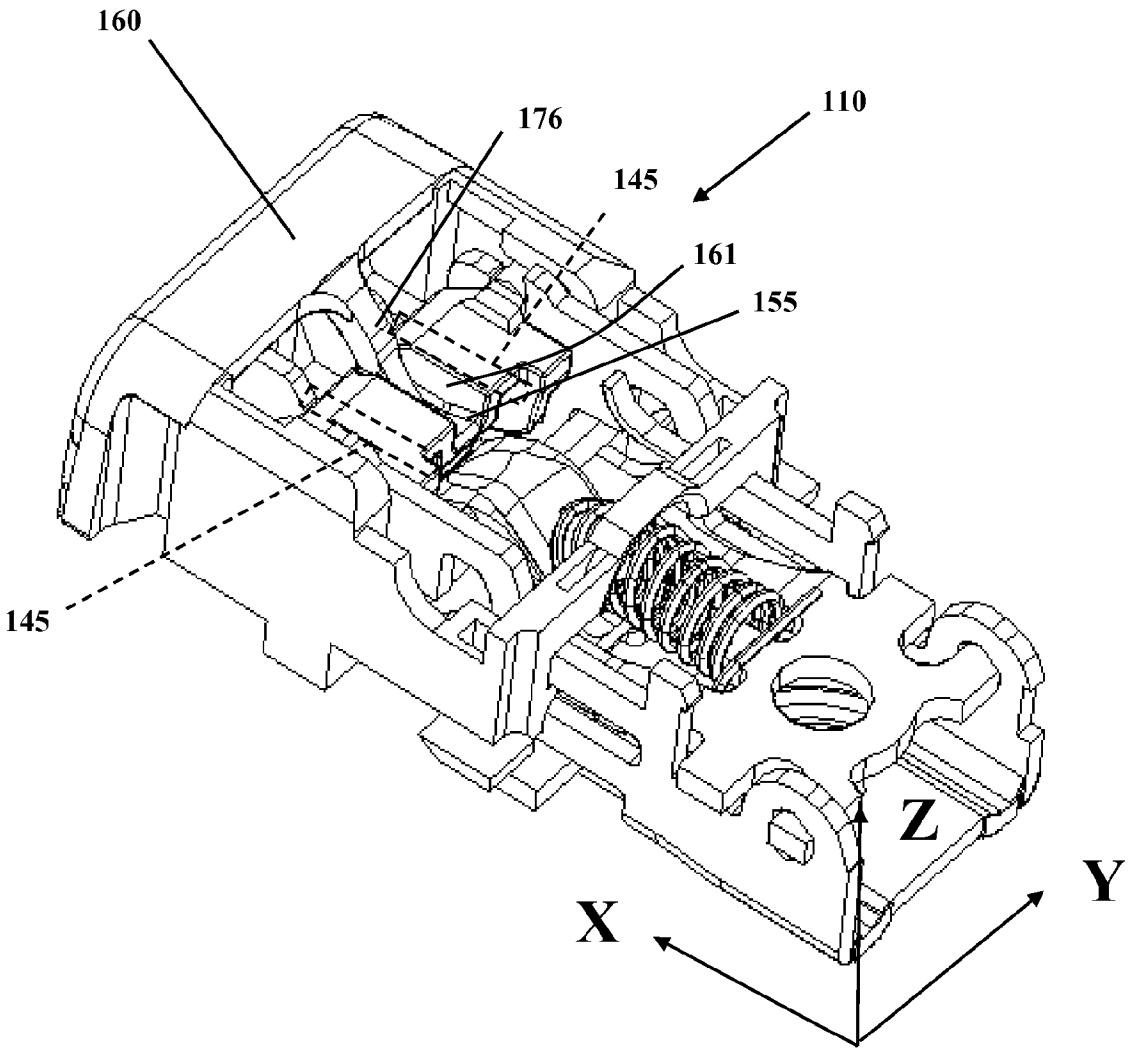
Figure 8:
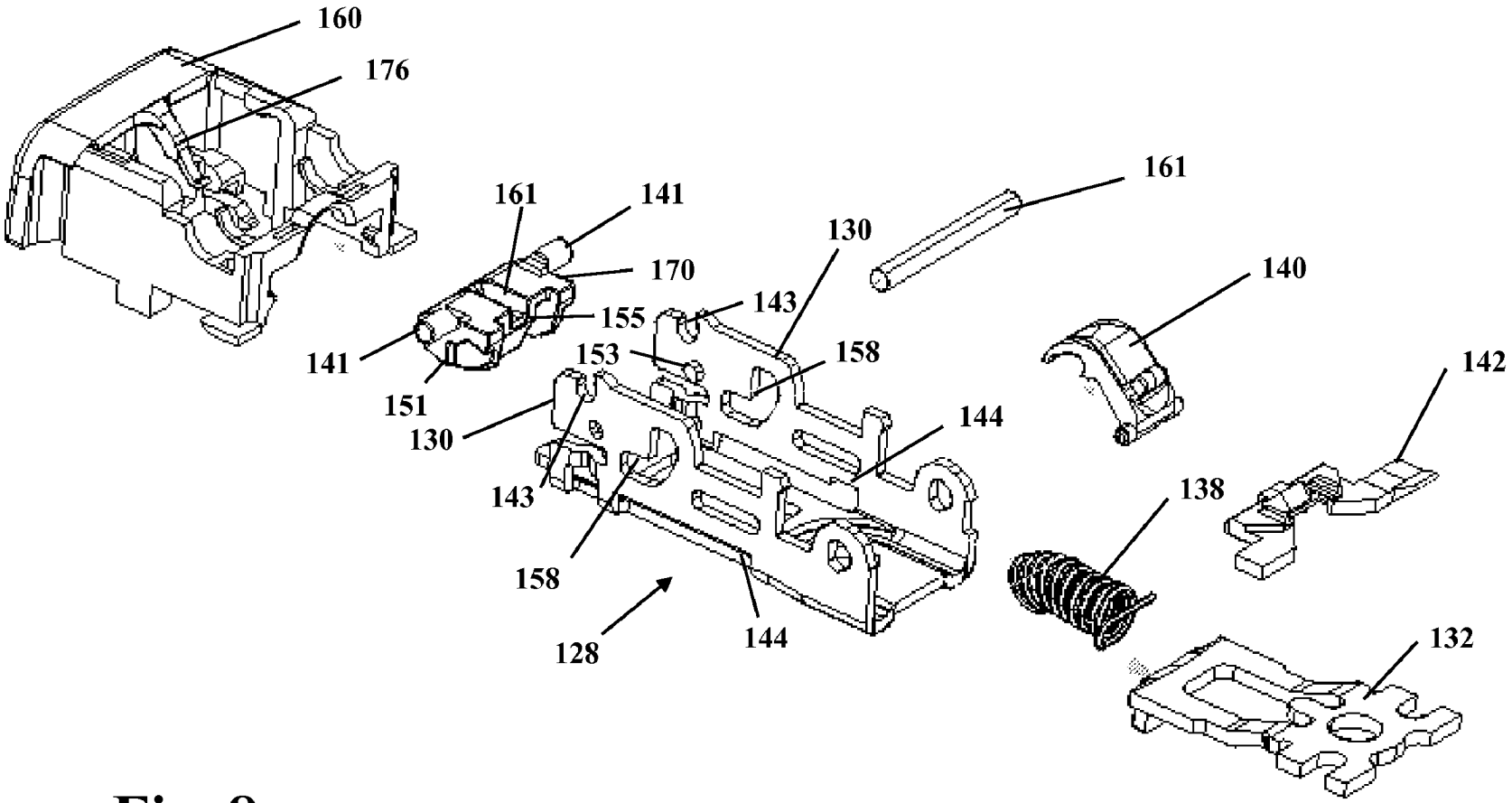
Figure 9:
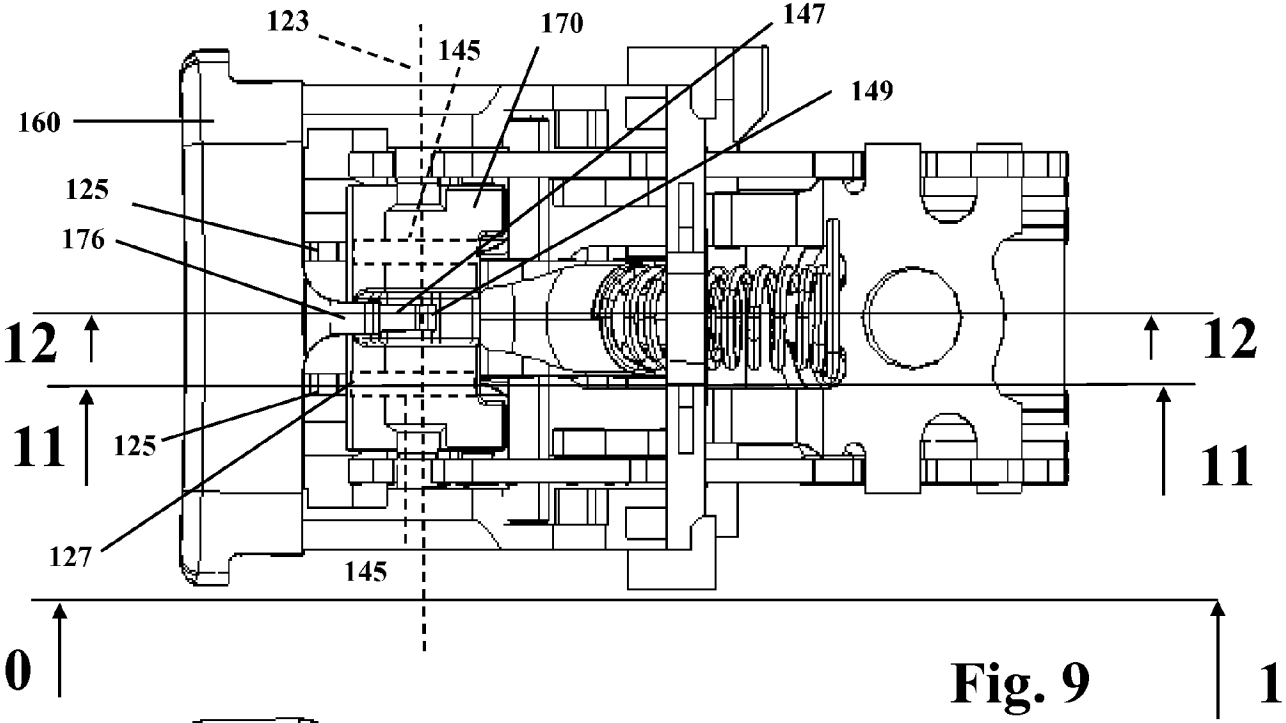
Figure 10:
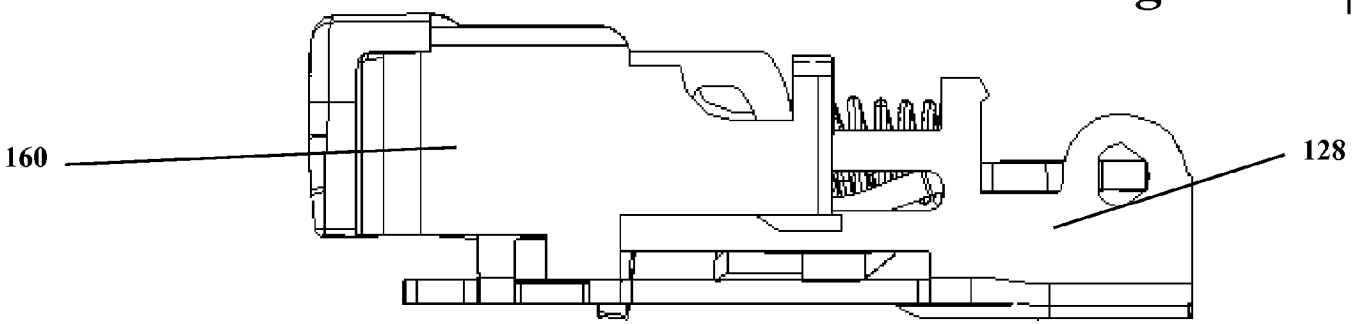
Figure 11A:
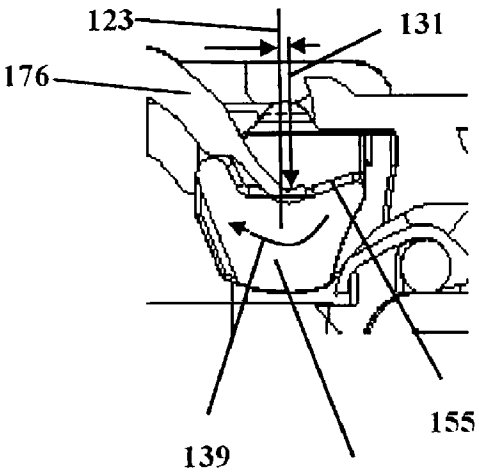
Figure 11:
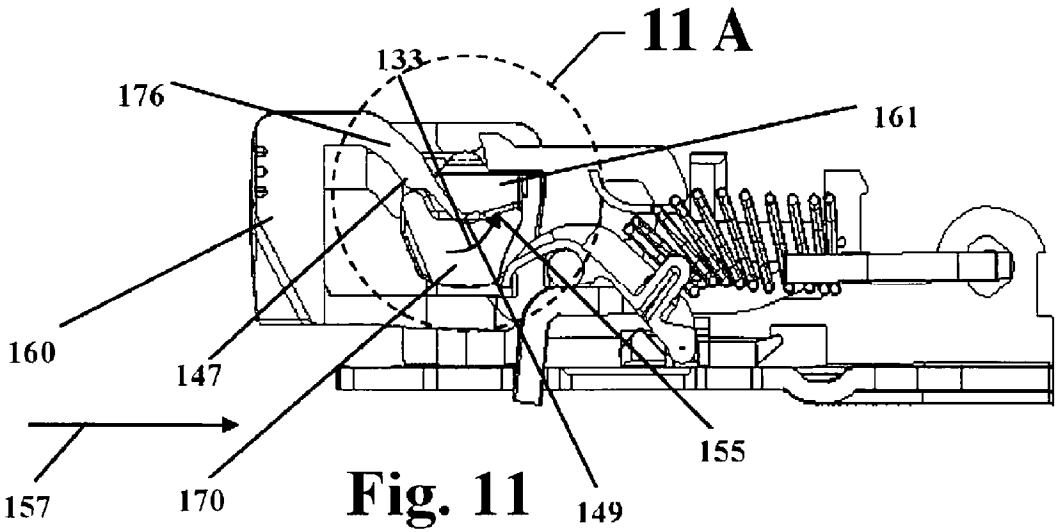
Figure 12:
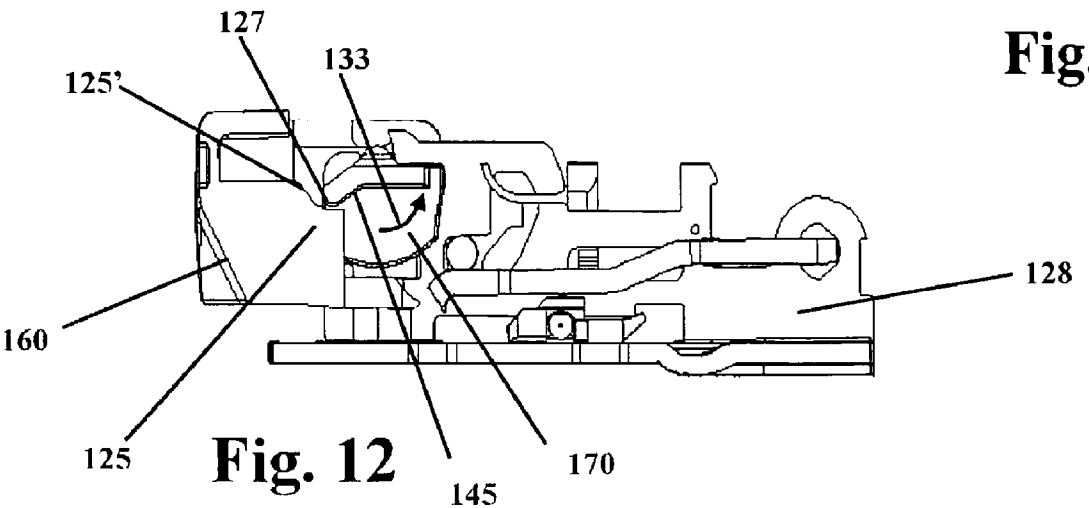
Figure 14:
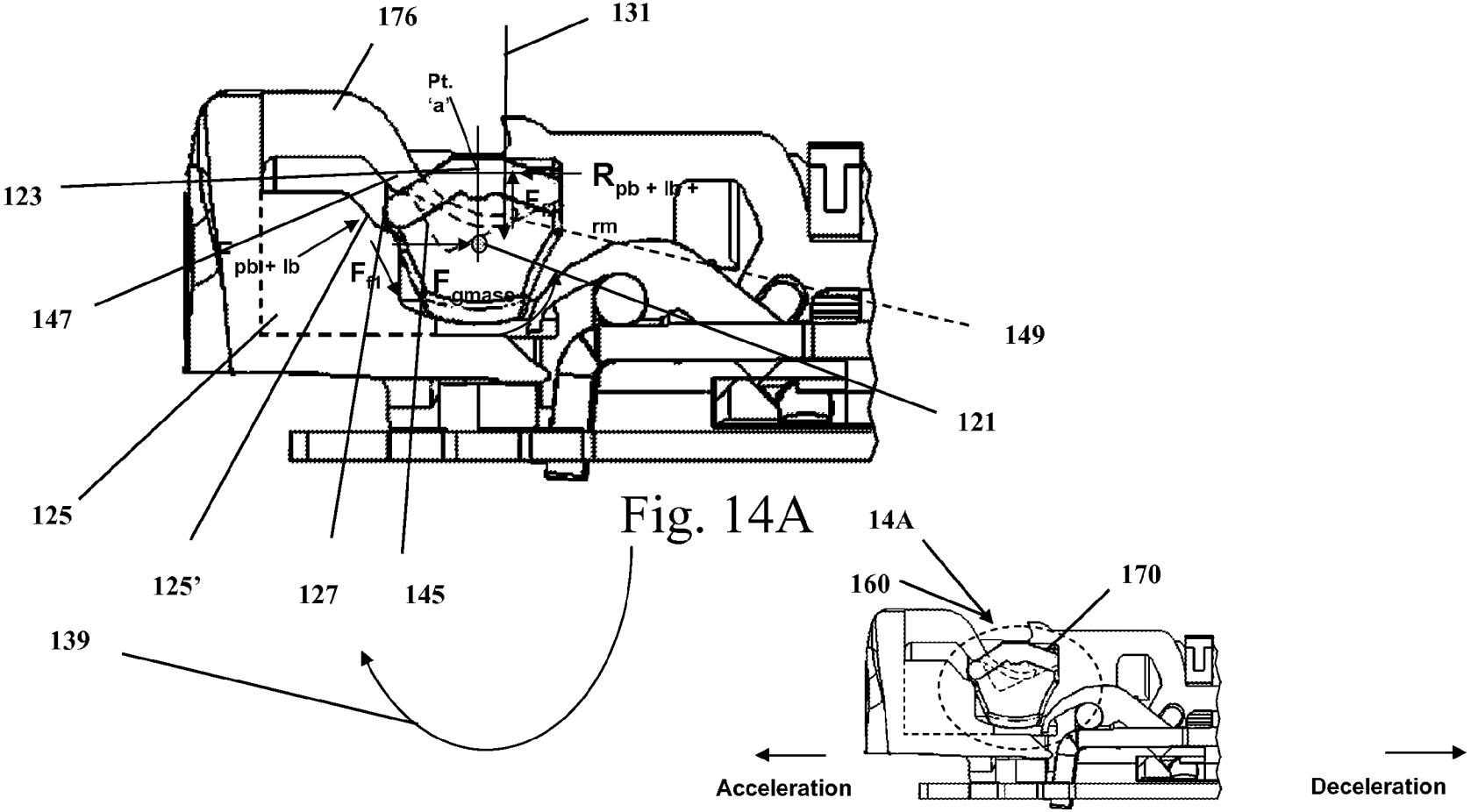
Figure 15A:
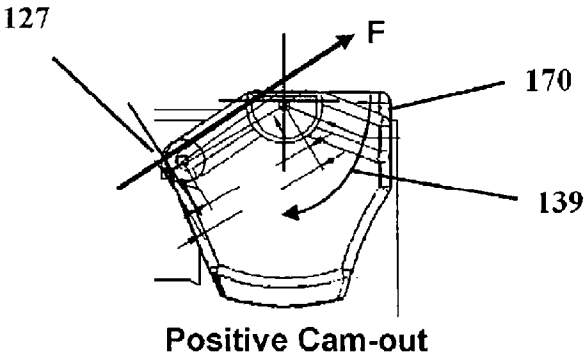
Figure 15:
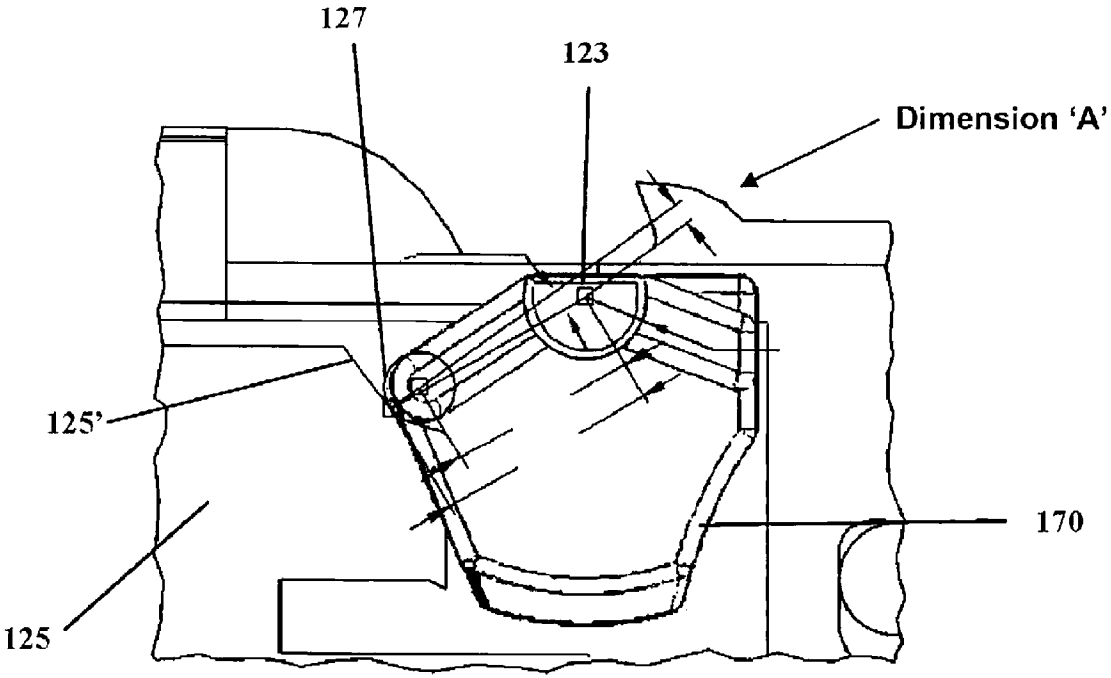
Figure 16:
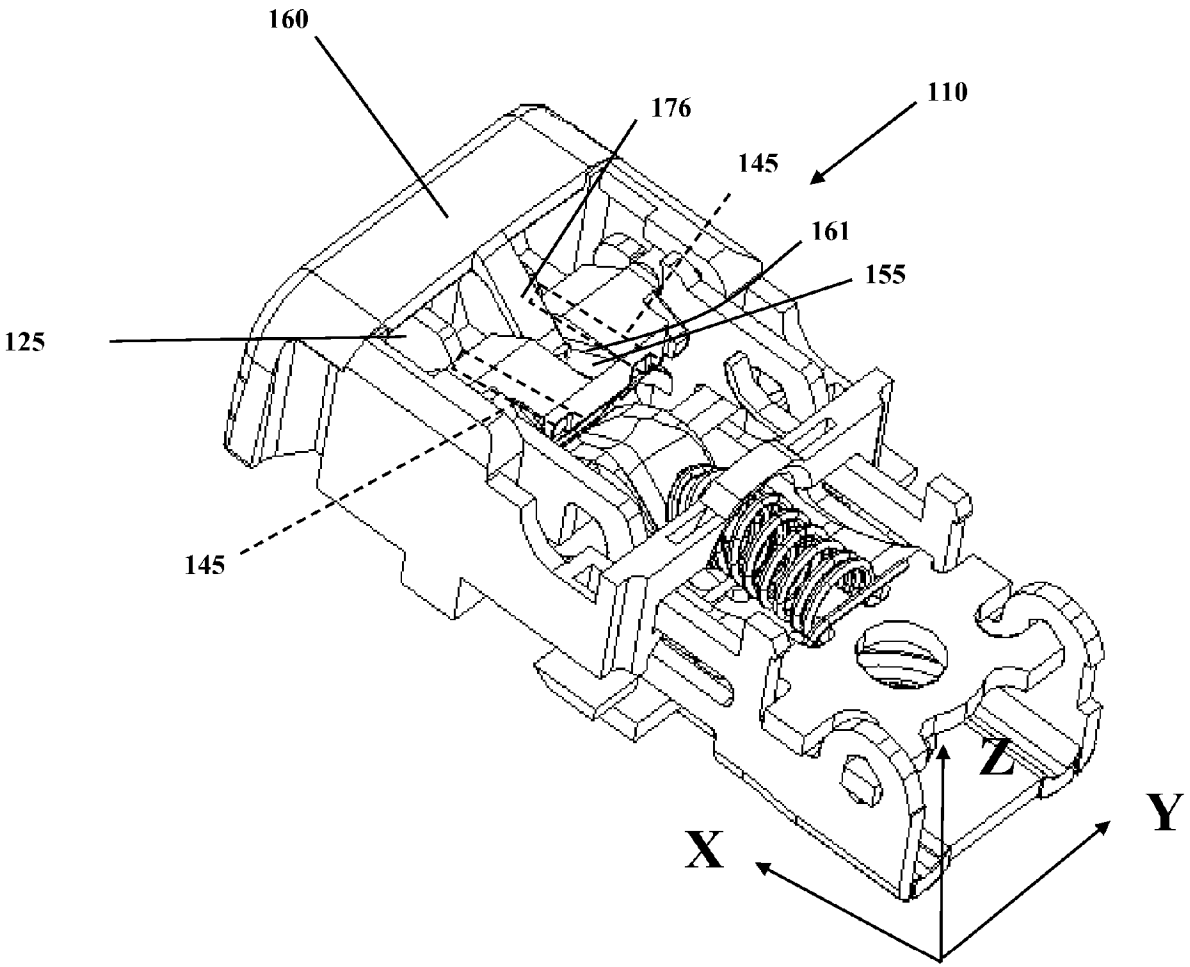
Figure 17:
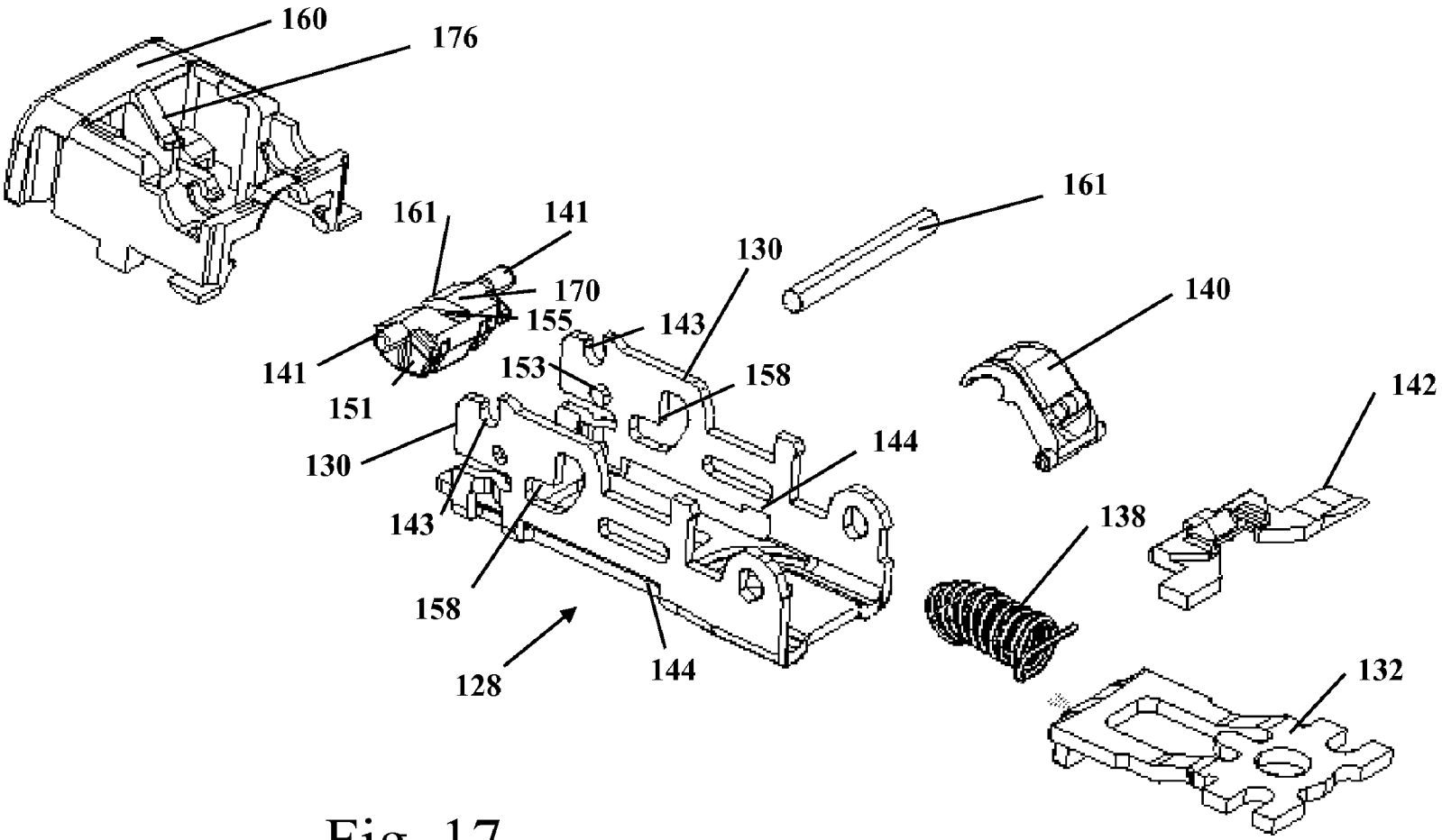
Figures 18, 19:
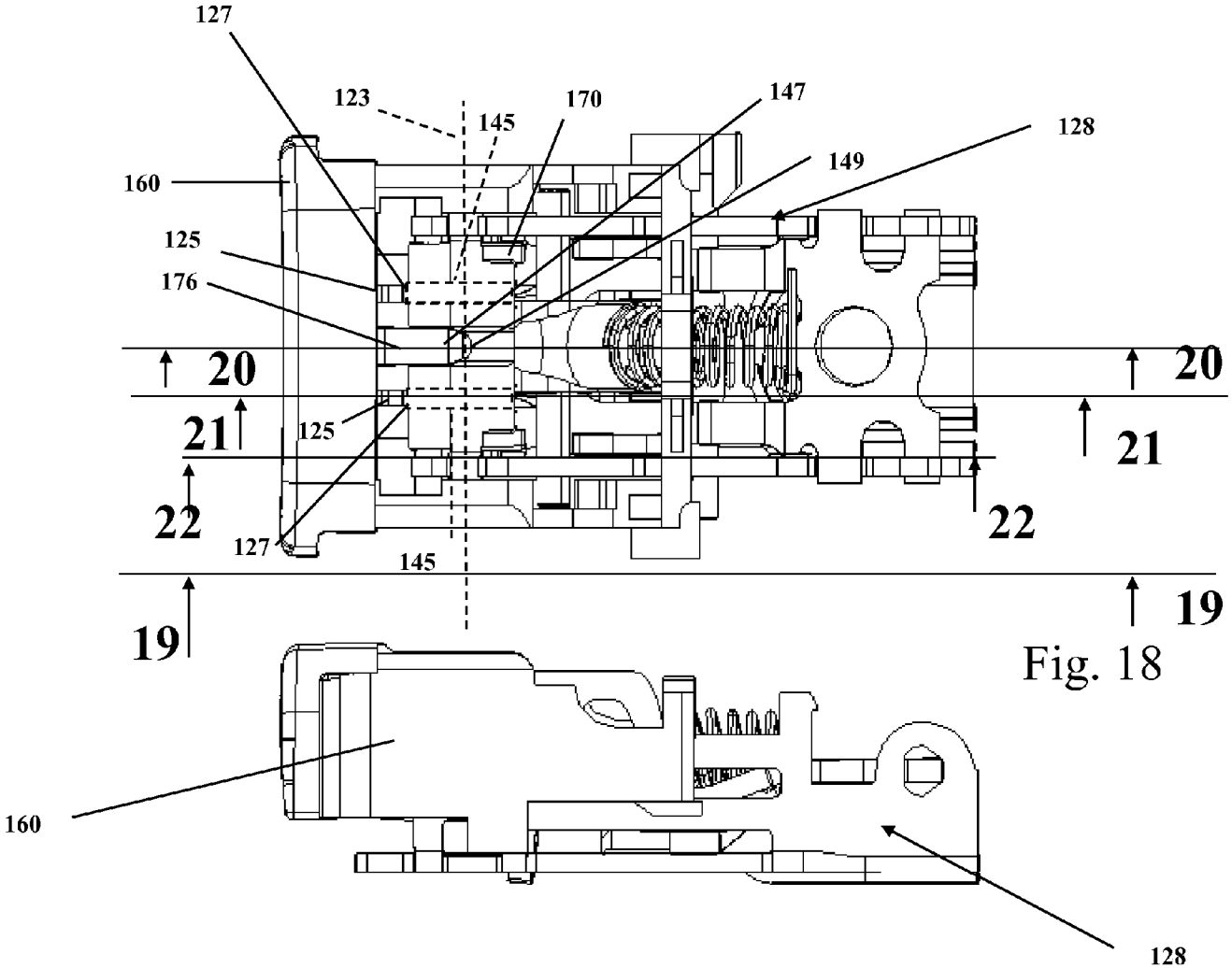
Figure 20A:
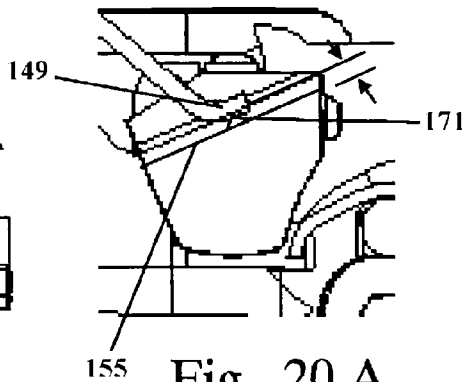
Figure 20:
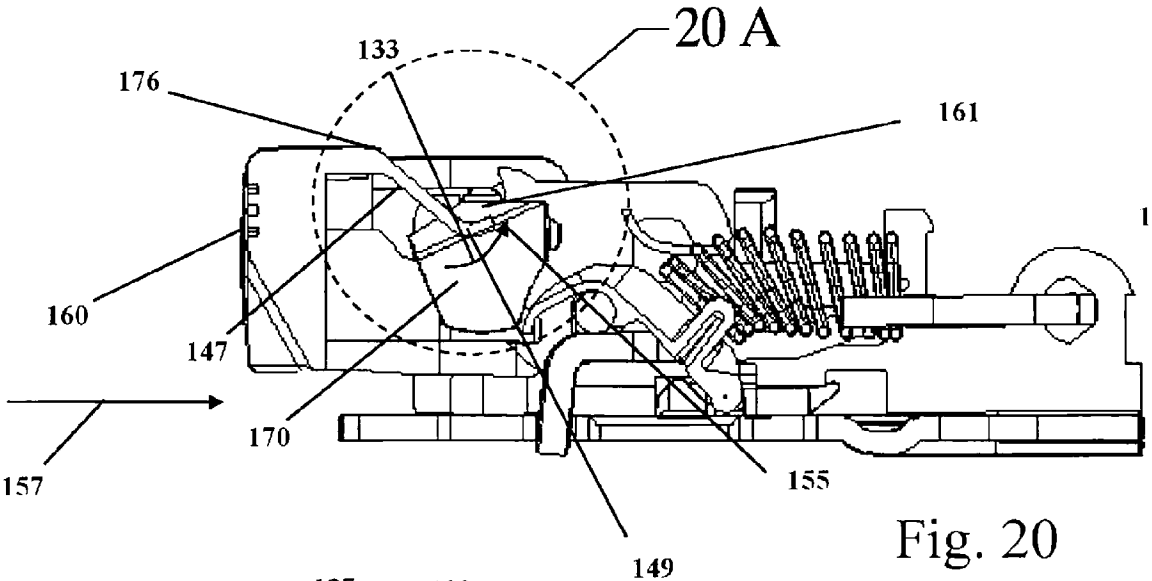
Figure 21:
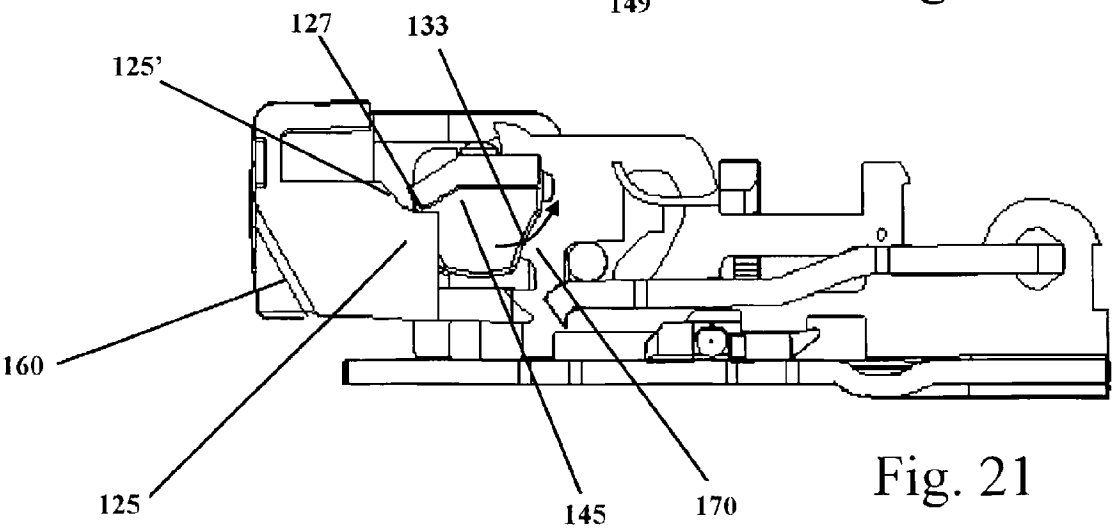

FIGS. 5, 5A, and 5B illustrate a blockout operation of the inertia locking device of exemplary embodiments of the present invention;

FIG. 6 illustrates a cam out operation of the inertia locking device of exemplary embodiments of the present invention;

FIG. 7 is a perspective view of a seat belt buckle constructed in accordance with an alternative exemplary embodiment of the present invention;

FIG. 8 is an exploded perspective view of a seat belt buckle constructed in accordance with an alternative exemplary embodiment of the present invention;

FIG. 9 is top plan view of a seat belt buckle constructed in accordance with an alternative exemplary embodiment of the present invention;

FIG. 10 is view along lines 10-10 of FIG. 9;

FIG. 11 is view along lines 11-11 of FIG. 9;

FIG. 11A is a magnified view of FIG. 11 showing details thereof;

FIG. 12 is view along lines 12-12 of FIG. 9;

FIGS. 13A-13E illustrate operation of a seat belt buckle constructed in accordance with exemplary embodiments of the present invention;

FIGS. 14-14A illustrates a blockout operation of the inertia locking device of an alternative exemplary embodiment of the present invention;

FIG. 15 illustrates a camout operation of an alternative exemplary embodiment of the present invention;

FIG. 15A is a magnified view of FIG. 11 showing details thereof;

FIG. 16 is a perspective view of a seat belt buckle constructed in accordance with an alternative exemplary embodiment of the present invention;

FIG. 17 is an exploded perspective view of a seat belt buckle constructed in accordance with an alternative exemplary embodiment of the present invention;

FIG. 18 is top plan view of a seat belt buckle constructed in accordance with an alternative exemplary embodiment of the present invention;

FIG. 19 is view along lines 19-19 of FIG. 18;

FIG. 20 is view along lines 20-20 of FIG. 18;

FIG. 20A is a magnified view of FIG. 20 showing details thereof;

FIG. 21 is view along lines 21-21 of FIG. 18; and

Figure 22B:
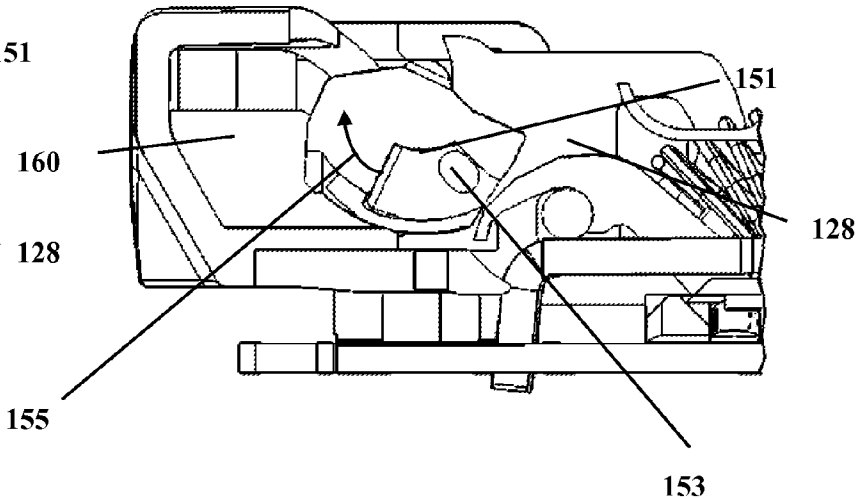
Figure 22A:
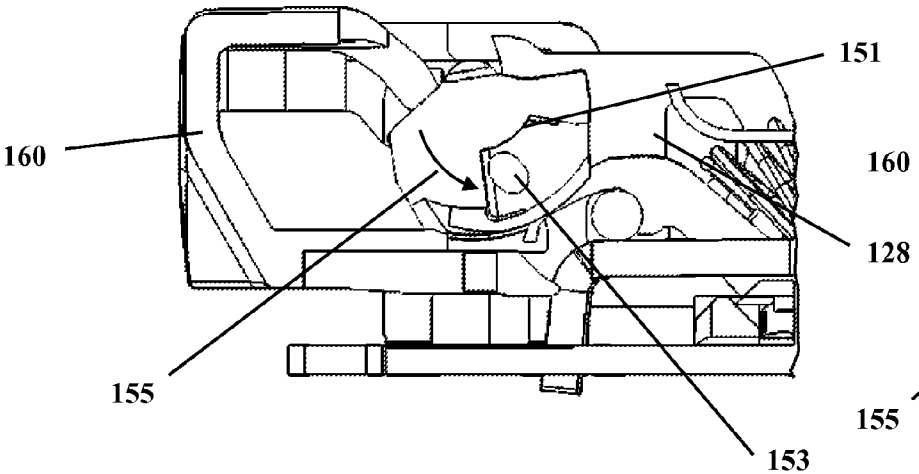

FIGS. 22A-22B are views along lines 22-22 of FIG. 18.

DESCRIPTION OF EXEMPLARY EMBODIMENTS

Disclosed herein is a seat belt buckle for use with a pre-tensioning device. When activated, the pre-tensioning device removes slack from a seat belt or retracts a predetermined amount of seat belt webbing, which is secured to either the seat belt buckle or a tongue of a seat belt. The present invention is also related to commonly owned and assigned U.S. patent application Ser. No. 10/945,308 filed Sep. 20, 2004, the contents of which are incorporated herein by reference thereto.

The seat belt buckle comprises a latch for securing a tongue of the seat belt to the seat belt buckle. The seat belt buckle further comprises a release button that actuates an ejector via a pin and a cantilever member pivotally mounted to the ejector. The ejector is slidably mounted to a frame portion of the seat belt buckle. The ejector is also configured to slide from a locking position to a release position, wherein insertion of the tongue in the seat belt buckle causes movement of the ejector towards the locking position and depression of the release button when the tongue is inserted in the seat belt buckle causes movement of the ejector from the locking position to the release position. In addition, movement of the ejector from the locking position to the release position causes an opening force via a lock bar, the cantilever and a spring to be applied to the latch in order to move the latch from a locking position towards an open position wherein the tongue portion of the seat belt is able to be removed from the seat belt buckle.

The seat belt buckle further comprises an inertia locking device or movable locking member rotatably mounted to the release button for movement between a locking or blocking position and an unlocking or unblocking position, wherein the inertia locking device prevents movement of the release button when the inertia locking device is in the locking position. The inertia locking device is biased or maintained into the unlocking position by a biasing force wherein the inertia locking device is capable of being rotated or moved into the locking position. In accordance with an exemplary embodiment, the inertia locking device is moved into the locking position when the seat belt buckle is subjected to a force that creates a moment in the locking device sufficient to overcome the biasing force applied to the inertia locking device by the spring members thereby causing rotational movement of the inertia locking device such that the pin member of the inertia locking device will make contact with the frame and prevent further movement of the release button.

In accordance with an exemplary embodiment, the inertia locking device via the spring members is moved or rotated back into the unlocking position when the seat belt buckle is no longer subjected to the force that creates the moment in the locking device which overcomes the biasing force of the spring members.

Moreover and in the event of the failure of the spring members providing the biasing force, the inertia locking device and the seat belt buckle frame are configured to allow the inertia locking to be rotated back into its unlocking position. This is achieved by providing cam out surfaces on the frame portion. Thus, and when the seat belt is no longer subject to the force, which creates the moment for rotating the inertia locking device the inertia locking device is capable of being moved back into its unlocking position even though spring members may no longer be in operation for providing the biasing force to the inertia locking device. In addition, and in accordance with an exemplary embodiment, the inertia locking device is configured to be affected or rotate in response to accelerations in two of three axes or directions.

Figure 1:
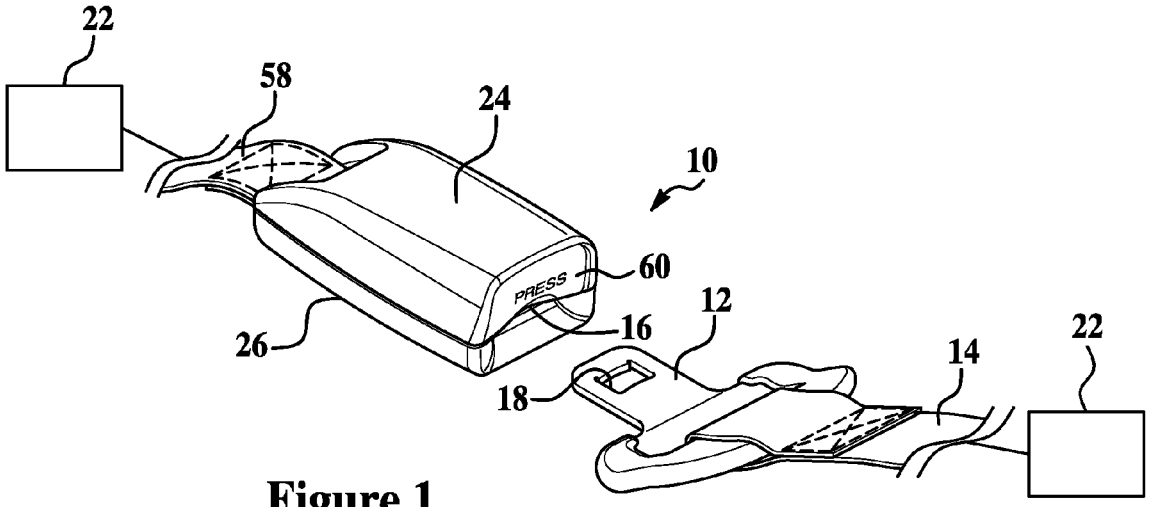
FIG. 1 is a perspective view of a seat belt buckle constructed in accordance with exemplary embodiments of the present invention.

Referring now to FIG. 1, a seat belt buckle 10 constructed in accordance with an exemplary embodiment of the present invention is illustrated. Seat belt buckle 10 is configured to receive and engage a tongue portion 12 connected to a seat belt webbing 14. The tongue portion 12 is received within an opening 16 of seat belt buckle 10. Upon insertion of tongue portion 12 into opening 16, a latch 32 of the buckle engages an opening 18 of tongue portion 12. In order to release the tongue portion from seat belt buckle 10, a release button 60 is depressed and tongue portion 12 is ejected from seat belt buckle 10.

Seat belt buckle 10 and/or tongue portion 12 is also secured to a pre-tensioning mechanism 22 (illustrated schematically by box 22), which in accordance with a predetermined activation event will cause the pre-tensioning mechanism to remove the slack from the seat belt webbing. As illustrated, the pre-tensioning mechanism may be secured to either the seat belt webbing of the tongue portion or the webbing securing the belt buckle to the vehicle or both. Non-limiting examples of pretensioning mechanisms (e.g., retractors and pretensioners for seat belt buckles, seat belts and seat belt anchors) are found in the following U.S. Pat. Nos. 6,340,176;

6,513,747; and 6,572,147 the contents of which are incorporated herein by reference thereto. U.S. Pat. No. 6,725,509, also incorporated herein by reference thereto, illustrates a seat belt buckle. U.S. Pat. No. 6,438,810 also incorporated herein by reference thereto, illustrates a seat restraint buckle assembly also designed for use with seat belt pretensioners that when deployed will cause the seat belt buckle to experience very high accelerations and very rapid decelerations. In one contemplated configuration for use with exemplary embodiments of the present invention, a pyrotechnically activated pre-tensioning device is secured to the seat belt buckle while a retractor is secured to the webbing having tongue portion 12 secured thereto. For example, the retractor may be located at the shoulder of the vehicle occupant while the pre-tensioner is disposed proximate to the vehicle floor panel where the seat is secured thereto.

Figure 2:
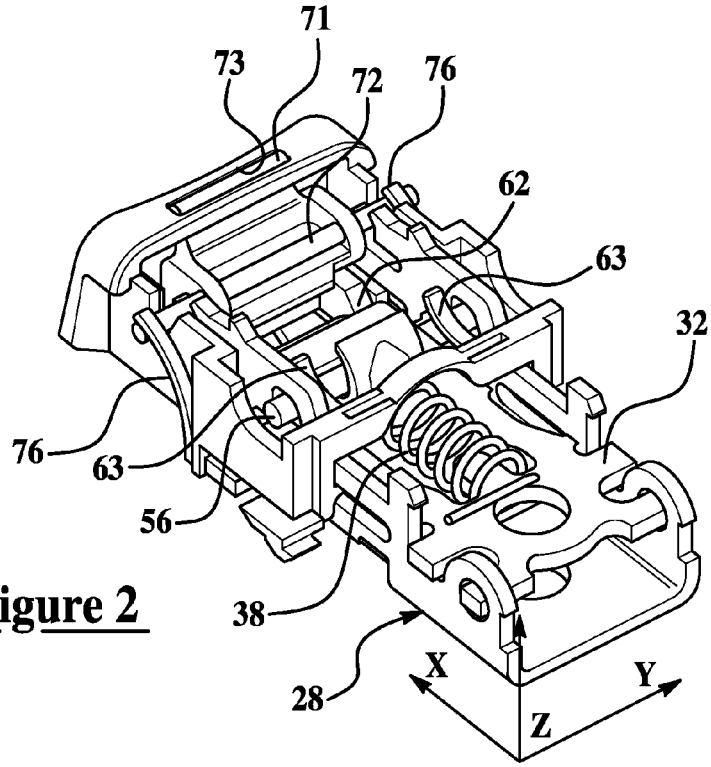
FIG. 2 is a perspective view of a seat belt buckle constructed in accordance with exemplary embodiments of the present invention.
Figure 3:
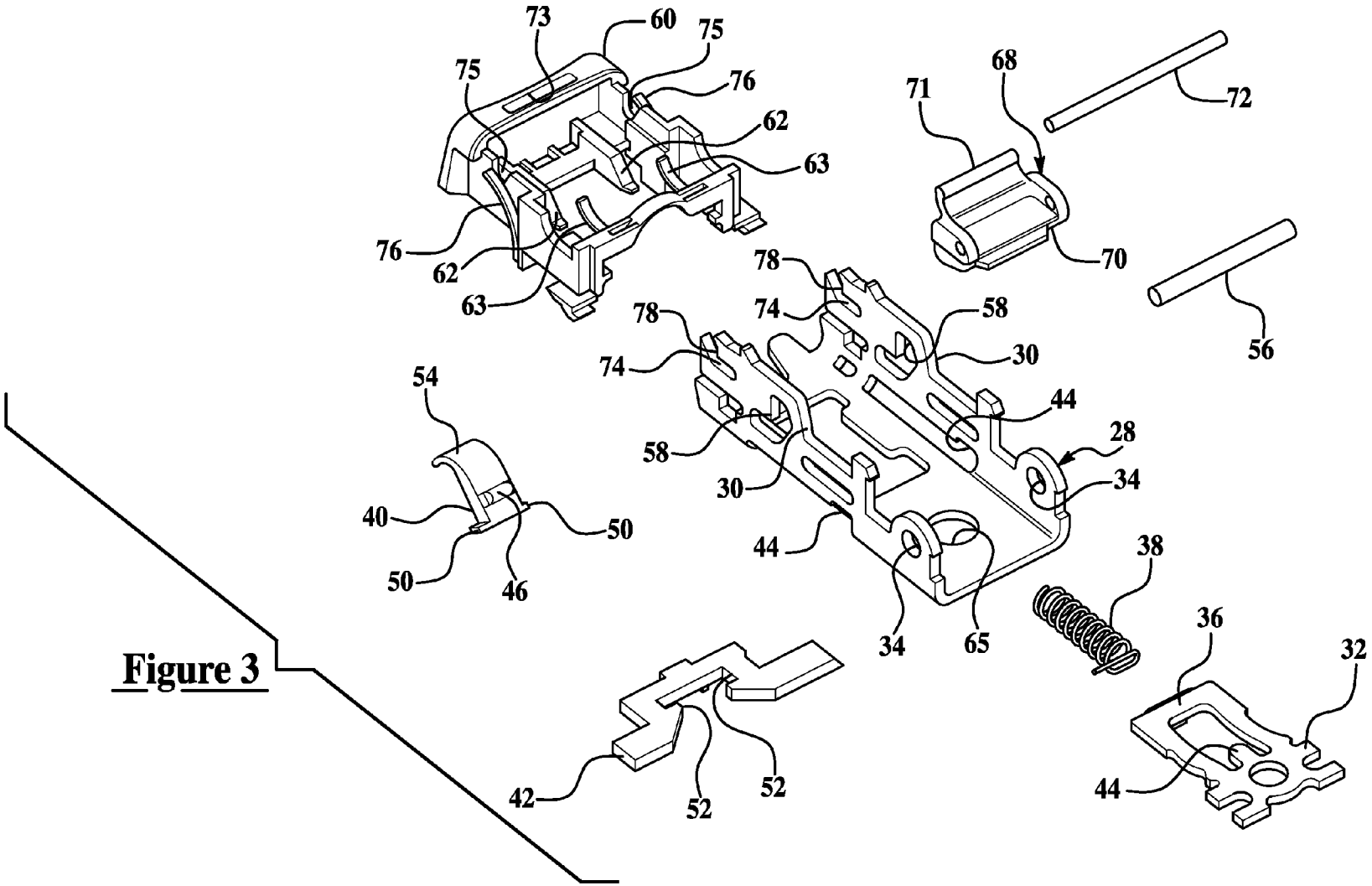
FIG. 3 is an exploded view of a seat belt buckle constructed in accordance with exemplary embodiments of the present invention.
Figure 4A:
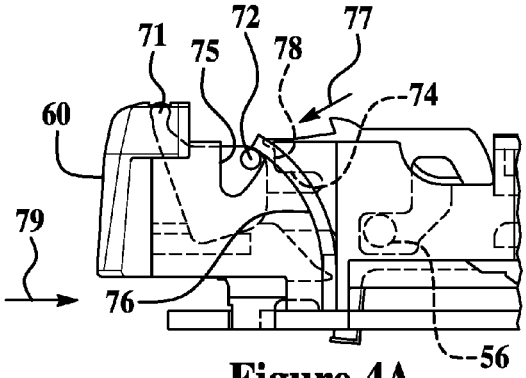
FIGS. 4A-4G illustrate operation of a seat belt buckle constructed in accordance with exemplary embodiments of the present invention.
Figure 4B:
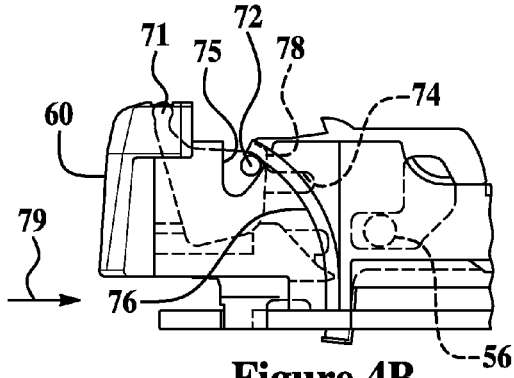
Figure 4C:
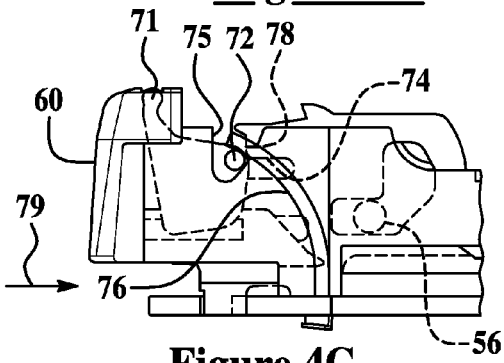
Figure 4D:
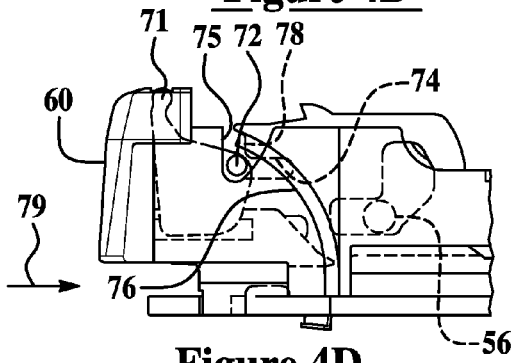
Figure 4E:
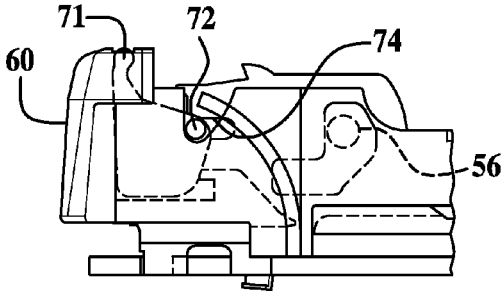
Figure 4F:
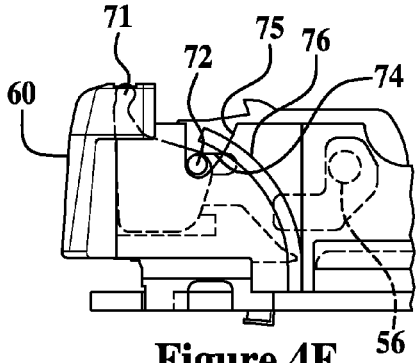
Figure 4G:
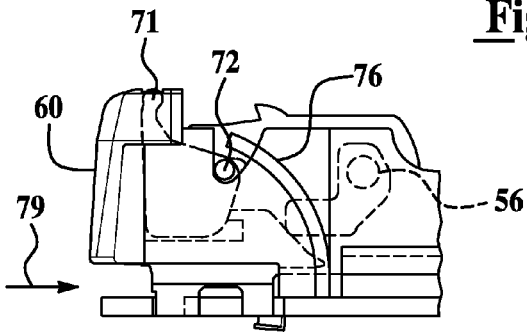

As illustrated, seat belt buckle 10 comprises an upper housing portion 24 and a lower housing portion 26 and a frame portion 28 received therein. Referring now to FIGS. 2 and 3, component parts of a seat belt buckle constructed in accordance with exemplary embodiments of the present invention are illustrated. FIG. 3 illustrates an exploded view of the seat belt buckle. As illustrated, seat belt buckle 10 comprises a frame portion 28. Frame portion 28 is configured to have a pair of sidewalls 30, which are configured to rotatably receive and engage a latch 32. Latch or latch portion 32 is configured to be received within a pair of openings 34 in sidewalls 30. Latch portion 32 further comprises a latching member 36 configured to engage opening 18 of tongue portion 12 as it is slid into belt buckle 10.

In order to rotate latch 32 into an unlocking position, a spring 38 is positioned between latch 32 and a cantilever 40. Cantilever 40 is pivotally mounted to an ejector 42 slidably received within a pair of the elongated openings 44 disposed in sidewalls 30. Spring 38 is positioned upon a protrusion 44 of latch 32 and a protrusion 46 of cantilever 40. During insertion of the tongue of the seat belt into the frame, the ejector is slid within elongated openings 44 and spring 38 is compressed thereby providing an urging force to cantilever 46 wherein cantilever 46 is rotated about its pivot pins 50, which are rotatably received in complimentary openings 52 in ejector 42.

As cantilever 40 is rotated an arm portion 54 of cantilever 40 urges a lock bar 56 to travel through slots 58 in sidewalls 30. In accordance with an exemplary embodiment slots 58 are "L" shaped to guide the lock bar into its release and locking positions. Of course, other configurations are contemplated to be within the scope of exemplary embodiments of the present invention. Upon insertion of tongue portion 12 into belt buckle 10, ejector 42 is longitudinally slid with respect to frame portion 28 and accordingly spring 38, which is disposed between cantilever 40 and latch 32, is compressed as the tongue portion is slid into the frame portion 28. During this movement latch 32 is rotated into an engaging position via lock bar or pin 56 such that tongue portion 12 is secured within belt buckle 10.

Thus, once the tongue is inserted into the frame of the buckle the tongue contacts and depresses the ejector, which compresses and stores energy in the spring. As the tongue depresses the ejector the latch will rotate through an aperture in the tongue. As the latch is rotated into the latched position the stored energy in the spring translates the lock bar in the slots of the frame to hold the latch in a latched state.

In order to eject or provide an urging force to slide tongue portion 12 out of the belt buckle, ejector 42, which is slidably mounted to frame portion 28 is configured to make contact with a distal end of tongue portion 12 as the same is being inserted into opening 16 of belt buckle 10. In order to slide lock bar 56 within openings 58 and ultimately move latch 32 into its release position, a release button 60 is configured to slidably engage sidewalls 30 while also providing a release force to lock bar 56, via a pair of integral cam surfaces 62. Thus, as release button 60 is depressed, an urging force is applied to the lock bar to slide it in openings 58. This movement will cause an urging force to be applied to the cantilever via lock bar 56 wherein cantilever 40 will rotate and compress spring 38. This movement allows the lock bar to be moved upwardly wherein latch 32 is free to pivot upwardly moving latch portion 36 out of opening 18 and ejector 42 is slid within openings 44 via the spring force of spring 38 thus, tongue 12 is ejected out of the buckle. In addition, the release button is configured to have a pair of cantilevered arms 63 each of which comprises a cam surface for contacting lock bar 56 when the latch is pushed upwardly and the tongue is removed from the seat belt buckle. In accordance with an exemplary embodiment, arms 63 provide a slight contact force to lock bar 56 in order to provide an anti-rattling feature.

Frame portion 28 further comprises an opening 65 in order to facilitate securement of a webbing material 64 that operably connects seat belt buckle 10 to a pre-tensioning mechanism 22. Normal operation or operation without the pretensioner being activated is illustrated in FIGS. 4A-4G.

In order to provide undesired movement of the lock bar within openings 58 (e.g., movement that is not attributable to depression of release button 60 by an individual or other person who is using the seat belt secured thereto namely, the activation of a pre-tensioning device) an inertia locking device 68 is movably or rotatably secured to release button 60. In exemplary embodiment, inertia locking device 68 comprises a rotating mass 70 pivotally secured to release button 60. In accordance with an exemplary embodiment the rotating mass is pivotally mounted to the release button by a lobe portion or integral pin portion 71 that is rotatably received or snapped into a receiving portion 73 of the release button. As illustrated, receiving portion 73 comprises an elongated opening for pivotally receiving pin portion 71 therein. Of course receiving portion 73 may have other configurations depending on the configuration of the lobe portion or integral pin portion 71 of the rotating mass.

In addition, a pin 72 is secured to mass 70. Pin 72 extends outwardly from either side of mass 70 and has its end portions received within openings 74 of the frame portion and openings 75 of the release button. Acting upon the end portions of the pin are a pair of biasing members or leaf springs 76. In accordance with an exemplary embodiment, leaf springs 76 are integrally formed with the release button. Leaf springs 76 are integrally formed with and thus secured to a side wall portion of the release button at one end and a freely movable portion at the other end. Leaf springs 76 are also configured to provide a biasing force in the direction of arrow 77 thus, pin 72 is urged downwardly in openings 75 such that during operator activation of release button 60 (e.g., depression of the release button in the direction of arrow 79) pin 72 is aligned with and will travel linearly within openings or slots 74 of the frame portion. In an exemplary embodiment, the mass is biased into an unblocking position via an urging force applied to pin 72 via leaf springs 76.

In addition, and when the mass and the pin are in the unblocking position more than 50 percent of the diameter of the pin is aligned or positioned with respect to opening 74 such that movement of the release button in the direction of arrow 79 will urge pin 72 into opening 75 (e.g., the curved surface of the pin corresponding to less than half of the diameter of the pin will allow the same to travel into the opening). Of course, other configurations and percentages of pin 72 for facilitating movement of the pin into opening 75 are contemplated to be within the scope of exemplary embodiments of the present invention. In addition, mass 70 may be configured to have a portion depending away from either side, wherein the integral portion is configured to be biased by springs 76 and travel through openings 74 and 75 as well as make contact with cam surface 78.

In accordance with an exemplary embodiment and as a release force is applied to the release button, the release button translates in a linear direction with respect to the frame. During this linear movement, the pin mounted to the rotating mass passes through two pairs of control apertures or openings—one pair being located in the frame and the other being located in the release button. As the release button is depressed the control apertures integral with the release button and the leaf springs react against the pin and cams the rotating mass to a neutral position (e.g., the position illustrated in FIGS. 4A and 4B). Leaf springs 76 provide a biasing force to pin 72 and mass 70 such that the same is biased in the neutral position, which also provides an anti-rattle feature wherein the pin and mass are prevented from rattling as they are held in contact with the release button as well as the frame. This is provided by configuring the mass such that the center of the mass is at a point where the springs will make contact with the pin when the release button is not being activated or depressed (e.g., a neutral position or unblocking or unlocking position of the mass). Moreover, the center of gravity of the mass is positioned so that it is not aligned with a pivot point of the mass with respect to the button (see FIG. 5 wherein the center of gravity of the mass is illustrated as "cg"). Finally, and as will be shown by the formulas below, the mass of the inertia locking device, and the location of its center of gravity with respect to its pivot point to the release button when compared to the mass and center of gravity of the push button or release button will cause the mass to overcome the biasing force of the leaf springs and rotate into the locking position prior to linear movement of the release button that would create or cause an unlatching of the seat belt buckle. Thus, the mass and pin 72 will rotate into the blocking or locking position when the seat belt buckle is subject to accelerations attributable to the activation of the pretensioners secured to the seat belt buckle.

FIGS. 4A-4G illustrate normal operation of seat belt buckle 10 while FIG. 5 illustrates the rotating mass block out theory of an exemplary embodiment of the present invention and FIG. 6 illustrates a cam out feature of an exemplary embodiment of the present invention.

As illustrated in FIGS. 4A-4G, the depression of release button 60 in the direction of arrow 79 is shown, which in this example is attributable to an operator depressing button 60 with their fingers in order to release the latch of the seat belt. As release button 60 is depressed, pin 72 which depends outwardly from either side of mass 70, travels through the slotted openings in frame 28. During this operation the pin will first make contact with a cam surface 78 and then travel downwardly with a corresponding rotation of mass 70. In addition, the biasing force of the biasing springs in the direction of arrow 77 will also guide pin 72 or rotate mass 70 such that pin 72 will tour downwardly first (FIGS. 4A and 4B) and then linearly in openings 74.

Thereafter, and as mass 70 has rotated slightly clockwise pin 72 will no longer make contact with spring 76 and travel in opening 74 in the direction of arrow 79. The lack of contact of spring 76 will prevent any unnecessary frictional forces caused by pin 72 making contact with the edges of opening 74 as the pin travels therethrough (FIGS. 4C-4G).

After the rotation of the mass, the biasing force of leaf springs 76 will define an uncompressed position of springs 76 wherein pin 72 and spring 76 are spaced from each other. Thereafter, the pin and button 60 with mass 70 will travel linearly in the direction of arrow 79 until the latch is released and the tongue is ejected from the seat belt buckle.

In accordance with an exemplary embodiment and referring now to FIG. 5 and when a retractor or anchor pretensioner is activated, the seat belt webbing attached to the tongue is pulled towards the retractor or anchor at a very high acceleration. Since the tongue described above is connected to the latch and subsequently the frame, the frame is displaced relative to the release button and the lock bar creates inertia forces on the release button and the lock bar. These combined inertia forces will act on the release button and cause the same to translate toward an unlatched condition (e.g., in the direction of arrow 79). However, and during this same high acceleration event and as viewed in FIG. 5, the rotating mass will rotate or pivot counter clockwise with respect to the release button wherein the biasing force of the leaf springs in the direction of arrow 77 is overcome and pin 72 and mass 70 rotate so as to align pin 72 with cam surface 78 of the frame. In accordance with an exemplary embodiment, mass 70, pin 72 and spring 76 are each configured to cause pin 72 to be aligned with surface 78 (e.g., a blocking or locking position) prior to release button 60 moving a sufficient distance in the direction of arrow 79 that would cause pin 72 to travel in opening 74 towards an unlocking position. In other words and in the blocking position, more than 50% of the diameter of the pin is positioned to make contact with the surface of the frame proximate to opening 74. See also FIG. 5B (e.g., blocking or locking position), wherein the spring is removed from the drawing to clearly illustrate the pin making contact with surface 78.

In accordance with an exemplary embodiment, the inertia forces acting on the seat belt buckle due the pre-tensioning devices will also act on the rotating mass. As such, the rotating mass will rotate into a blockout position with respect to the control apertures (e.g., openings 74) integral with the frame. Since the lock bar acts in conjunction with the release button, a latched state of the buckle will be maintained by preventing translation of the release button in the direction of arrow 79.

In accordance with an exemplary embodiment openings 75 of the release button are slotted openings or channels having an open top and a nearly vertical edge facing an angularly positioned edge, wherein the angular positioned edge is located closer to the spring members and the cam surfaces in order to facilitate the movement of pin 72 therein. Also, and in accordance with an exemplary embodiment release button 60 is formed from an easily molded material such as plastic thus biasing members or springs 76 are also plastic and integrally molded therewith.

The inertia blockout of the release button and lock bar is maintained because inertia forces acting on the rotating mass are greater than the inertia forces tending to force the pin out of the blockout position (e.g., movement away from the cam surface).

In accordance with an exemplary embodiment, the mass will have a center of gravity substantially below a rotating mass pivot point or the securement point of the rotating mass to the release button.

During activation of the pretensioner, the seat belt buckle experiences acceleration in all three axes X, Y & Z (illustrated in FIG. 1), therefore the blockout feature must operate under accelerations in all three axes. In accordance with an exemplary embodiment, the rotating mass is configured for movement or rotation in a plane substantially parallel to a plane of movement of the latch, wherein a portion of the inertia locking device makes contact with the frame and prevents movement of the release button when the inertia locking device is in the blocking position. Accordingly, exemplary embodiments of the present invention are sensitive to accelerations in the X and Z axes only and eliminates sensitivity to accelerations in the Y axis. In other words, acceleration in the X and Z axes will cause movement of the mass relative to the frame while acceleration in the Y axes will not cause rotation of the inertia locking device or movement of release button 60.

Thus, and when belt buckle 10 is subjected to a force, which creates a moment in inertia locking device 68, mass 70 and the ends of pin 72 overcome the biasing force of springs 76 and rotate into a locking position wherein the ends of pin 72 make contact with cam surfaces 78 of the frame portion and movement of the release button is prevented. Thus, unwanted movement of latch 32 will not occur. This feature is illustrated in FIG. 5.

In accordance with an exemplary embodiment, the rotating mass blockout theory is explained as follows, wherein:

$F_f$=Frictional Force $F_{rm}$=Force of Rotating Mass $R_{pb}+lb+rm$=Reaction Force of the Push Button+Lock Bar+Rotating Mass $F_{pb}+lb$=Force Pushbutton+Lock Bar $$\Sigma M_a=0=+M_1-M_2-M_3$$

$$M_1<M_2+M_3$$

$$R_{pb}+lb+rm\times L_1<F_{rm}\times L_2+F_f\times L_3$$

In accordance with an exemplary embodiment $M_1<M_2+M_3$ thus, the mass will rotate into the blocking position.

Accordingly, and as shown in the above example, the inertia forces will rotate the mass into the blockout position illustrated in FIG. 5, when $M_2+M_3$ is greater than $M_1$. As such, exemplary embodiments are configured so that the sensitivity of the mass to accelerations in the X-direction (FIG. 1) are significant enough to overcome rotation of the buckle or Z-direction accelerations (FIG. 1).

It is also noted that cam or contact surfaces 78 are configured to have a cam out feature in the event of a failure of the leaf springs. Thus, a fail-safe mode of operation is provided. For example, after a pretensioner has been deployed, the occupant must be able to operate the release button and delatch the buckle. In the event of a leaf spring failure, the frame's openings are designed with a positive cam-out feature, wherein and as the release button is depressed the cam surface of the frame will make contact with the pin and urge the rotating mass downwardly so pin 72 can travel in opening 74. As a force on the release button is increased, the forces acting on the rotating mass pin will increase to the point sufficient to overcome the friction forces and the ramp angle of the cam surfaces 78 of the frame portion will cause the rotating mass and pin 72 to translate out of the blockout position. This feature is illustrated in FIG. 6.

In accordance with an exemplary embodiment, the cam out theory may be explained as follows:

In order to provide cam-out in the event of leaf spring failure the Force of the push button must be greater than the Frictional Force $F_{pb}>F_f$.

$$\Sigma M_a=0=M_1-M_3$$

$$M_1>M_3$$

$$R_{pb}\times L_1>F_f\times L_3$$

$$R_{pb}\times L_1>0.2\times(R_{pb})\times L_3$$

In the case of spring failure (integral leaf springs), the frame cutout or surface 78 will provide a cam-out when the pushbutton force is sufficient to overcome the opposing friction forces.

Referring now to FIGS. 7-22 other alternative exemplary embodiments of the present invention are now illustrated. Here components performing similar or analogous functions are labeled in multiples of 100.

Here a seat belt buckle 110 has an inertia locking device, G-mass, mass or movable locking member 170 rotatably or pivotally mounted to a frame portion 128 for movement between a locking or blocking position and an unlocking or unblocking position, wherein the inertia locking device prevents movement of a release button 160 and/or lock bar 156 when the inertia locking device is in the blocking position. The inertia locking device or G-mass is biased or maintained into the unblocking position by a biasing force wherein the inertia locking device is capable of being rotated or moved into the blocking position when a force greater than the biasing force is applied to the mass or inertia locking device and the mass is rotated into a blocking position. In one non-limiting exemplary embodiment, the inertia locking device and the frame portion is constructed out of a metal or metal alloy and the release button is formed from an easily molded material such as plastic. Of course, other materials are contemplated to be within the scope of exemplary embodiments of the present invention.

In accordance with an exemplary embodiment, the inertia locking device is moved into the locking position when the seat belt buckle is subjected to a force that creates a moment in the locking device sufficient to overcome the biasing force applied to the inertia locking device by a biasing member, spring member or other equivalent items thereby causing rotational or pivotal movement of the inertia locking device such that the inertia locking device will prevent further movement of the release button.

In accordance with an exemplary embodiment, the inertia locking device via an integral biasing member 176 of the release button is moved or rotated back into the unlocking position when the seat belt buckle is no longer subjected to the force that creates or created the moment in the locking device which overcomes the biasing force of the biasing member or spring. Of course, biasing member 176 may be non-integral with the release button such as a spring inserted into a cavity of the release button.

Moreover and in the event of the failure of the spring member or biasing member providing the biasing force to the mass, the mass, inertia locking device or G-mass and a cam surface of the release button are configured to allow the inertia locking device to be rotated back into its unlocking position when the buckle is no longer subject acceleration forces and the release button is depressed. This is achieved by providing cam out surfaces on the G-mass and the release button. Thus, and when the seat belt is no longer subject to the force, which creates the moment for rotating the inertia locking device, the inertia locking device is capable of being moved back into its unlocking or unblocking position even though the biasing member may no longer be in operation for providing the biasing force to the inertia locking device or mass. In addition, and in accordance with an exemplary embodiment, the inertia locking device is configured to be affected or rotate in response to accelerations in one of three axes or directions.

Referring now to FIGS. 7-16, a seat belt buckle 110 constructed in accordance with alternative exemplary embodiments of the present invention is illustrated. As in the previous embodiments, seat belt buckle 110 is configured to receive and engage a tongue portion connected to a seat belt webbing in a similar fashion to the previous embodiments. The tongue portion is received within an opening of the seat belt buckle. Upon insertion of tongue portion into opening, a portion of a latch 132 of the buckle engages an opening of the tongue portion. In order to release the tongue portion from the seat belt buckle, the release button 160 is depressed and slid from a first position to a second position wherein the tongue portion is ejected from the seat belt buckle.

The seat belt buckle and/or tongue portion is also secured to a pre-tensioning mechanism (illustrated schematically in FIG. 1), which in accordance with a predetermined activation event will cause the pre-tensioning mechanism to remove the slack from the seat belt webbing. As illustrated, the pre-tensioning mechanism may be secured to either the seat belt webbing of the tongue portion or the webbing securing the belt buckle to the vehicle or both. Non-limiting examples of pretensioning mechanisms (e.g., retractors and pretensioners for seat belt buckles, seat belts and seat belt anchors) are found in the following U.S. Pat. Nos. 6,340,176; 6,513,747; and 6,572,147 the contents of which are incorporated herein by reference thereto. U.S. Pat. No. 6,725,509, also incorporated herein by reference thereto, illustrates a seat belt buckle. U.S. Pat. No. 6,438,810 also incorporated herein by reference thereto, illustrates a seat restraint buckle assembly also designed for use with seat belt pretensioners that when deployed will cause the seat belt buckle to experience very high accelerations and very rapid decelerations. In one contemplated configuration for use with exemplary embodiments of the present invention, a pyrotechnically activated pre-tensioning device is secured to the seat belt buckle while a retractor is secured to the webbing having the tongue portion secured thereto. For example, the retractor may be located at the shoulder of the vehicle occupant while the pre-tensioner is disposed proximate to the vehicle floor panel where the seat is secured thereto.

As illustrated in FIGS. 7-16, component parts of a seat belt buckle 110 constructed in accordance with an exemplary embodiment of the present invention are shown. Normal engagement and disengagement of the tongue of the seat belt is similar to the embodiments of FIGS. 1-6 described above.

In order to rotate the latch into an unlocking or unlatching position, a spring 138 is positioned between the latch and a cantilever 140. The cantilever 140 is pivotally mounted to the ejector 142 slidably received within a pair of the elongated openings 144 disposed in the sidewalls. The spring is positioned upon a protrusion of the latch and a protrusion of the cantilever. During insertion of the tongue of the seat belt into the frame, the ejector is slid within the elongated openings and the spring is compressed thereby providing an urging force to the cantilever wherein the cantilever is rotated about its pivot pins, which are rotatably received in complimentary openings in the ejector.

As the cantilever is rotated an arm portion of the cantilever urges the lock bar to travel through slots 158 in the sidewalls of the frame. In accordance with an exemplary embodiment the slots are "L" shaped to guide the lock bar into its release and locking positions. Of course, other configurations are contemplated to be within the scope of exemplary embodiments of the present invention. Upon insertion of the tongue portion into the buckle, the ejector is longitudinally slid with respect to the frame portion and accordingly the spring, which is disposed between the cantilever and the latch, is compressed as the tongue portion is slid into the frame portion. During this movement the latch is rotated into an engaging position via the lock bar or pin such that tongue portion is secured within the belt buckle.

Thus, once the tongue is inserted into the frame of the buckle, the tongue contacts and depresses the ejector, which compresses and stores energy in the spring. As the tongue depresses the ejector the latch will rotate through an aperture in the tongue. As the latch is rotated into the latched position the stored energy in the spring translates the lock bar in the slots of the frame to hold the latch in a latched state.

In order to eject or provide an urging force to slide the tongue portion out of the belt buckle, the ejector, which is slidably mounted to the frame portion is configured to make contact with a distal end of the tongue portion as the same is being inserted into the opening of the belt buckle. In order to slide the lock bar within the openings and ultimately move the latch into its release position, the release button is configured to slidably engage the sidewalls of the frame portion while also providing a release force to the lock bar. In accordance with an exemplary embodiment of the present invention the release button is configured for slidable movement between a first position and a second position. Thus, as the release button is depressed and the release button is slid from a first position to a second position, an urging force is applied to the lock bar to slide it in the openings in the frame.

In accordance with an exemplary embodiment, the operation of the anti-g buckle is as follows. During a normal buckle latching condition, the seat belt webbing is connected to the tongue, which is inserted into the opening of the buckle assembly for latching. The tongue contacts and depresses the ejector and stores energy in the spring-ejector, as the ejector is depressed by the tongue it contacts the latch and rotates the latch through an aperture in the tongue. As the latch is rotated into the latched position the stored energy in the ejector spring translates the lock bar in a slot in the frame over the latch to hold the latch in a latched state.

During normal buckle unlatching, the operation is as follows; the pushbutton is depressed and moved from a first position to a second position wherein the release button translates in a linear fashion relative to the frame. As the pushbutton is depressed the G-mass, mass or inertia locking device is cammed and rotated to a 'neutral' position, which allows removal of the tongue from the buckle. During this operation a biasing member also applies a force to rotate the inertia locking device into an unblocking position wherein cam surfaces of the release button are allowed to move past a contact surface of the inertia locking device.

During seat belt pretensioning, when a retractor or anchor pretensioner is activated is as follows; the seat belt webbing attached to the tongue is pulled towards the retractor or anchor at a very high acceleration. Since the tongue is connected to the latch and subsequently the frame portion, the frame portion is displaced relative to the pushbutton and the lock bar and thus inertia forces act on the pushbutton and the lock bar. The combined inertia forces of the pushbutton and the lock bar may translate toward an unlatched position.

In accordance with an exemplary embodiment, the G-mass, inertia locking device or mass has a center of gravity 121 inline with a G-mass pivot point or axis 123 (See FIG. 15). During this same high acceleration event the inertia forces will cause the G-mass to rotate into a blockout or blocking position with respect to a cam surface of the release button. In accordance with an exemplary embodiment the cam surface comprises a pair of integral ribs 125 each having a control surface or cam surface 125' integral with the pushbutton or release button. Of course, other configurations are considered to be within the scope of exemplary embodiments of the present invention. During this same high acceleration event the G-mass with a center of gravity inline with the G-mass pivot or axis, the inertia forces acting on the G-mass will cause the G-mass to rotate into a blockout or blocking position wherein a block out feature or contact surface 127 of the inertia locking device contacts the control surface of cam surface of the release button. Since the lock bar acts in conjunction with the pushbutton, a latched state of the buckle can be maintained by preventing translation of the pushbutton.

Referring to FIG. 11, the direction of the biasing force of the biasing member is illustrated by arrow 131 and the rotational direction of the inertia locking device is illustrated by arrow 133. Accordingly and in order to rotate the inertia locking device the force of the rotating inertia locking device in the direction of arrow 133 must be greater than the force of the biasing member 176 in the direction of arrow 131. Also, and as shown in FIG. 11A the force of the biasing member is offset from the pivot point or axis of rotation 123 of the inertia locking device. This provides a biasing force on the inertia locking device in order to bias the inertia locking device into the unblocking position.

The inertia blockout of the pushbutton and lock bar is maintained because inertia forces acting on the G-mass or inertia locking device are greater than the inertia forces acting on the combined release button and lock bar mass trying to force the G-mass out of the blockout position thus, the inertia locking device moves towards the blocking position wherein the contact surface of the inertia locking device makes contact with the cam surface of the release button.

During activation of the pretensioner, the seat belt buckle 110 experiences acceleration in all three axes X, Y & Z (see FIG. 7), therefore the blockout feature must operate under accelerations in all three axes. In accordance with an exemplary embodiment, the anti-G buckle or inertia locking device is sensitive to acceleration in the X axis only and eliminates sensitivity to accelerations in the other two axes the Y and Z.

Sensitivity to acceleration in the Z direction is eliminated by positioning the center of gravity of the G-mass or inertia locking device in line with the Z axis of or pivot axis 123 of the inertia locking device. A second degree of sensitivity is eliminated because the inertia locking device cannot rotate in the 'Y' axis therefore it is immune to accelerations in the 'Y' axis.

The buckle 110 also has a fail safe operation, after a pretensioner has been deployed, the occupant must be able to operate the release button and unlatch the buckle 110. In the event of a failure of the biasing member integral with the release button, the inertia locking device has a cam-out feature to unlatch the buckle. For example, and as illustrated in FIGS. 15-15A, when the release button is depressed and moved from the first position towards the second position, the control surface or cam surface 125' integral with the release button will make contact with the inertia locking device contact surface 127. As a force on the release button is increased the forces acting on the contact surface will increase to the point sufficient to overcome the friction forces and the ramp angle between the cam surface and the contact surface and thus the inertia locking device will rotate in the direction of arrow 139 and the inertia locking device will translate or rotate out of the blocking position into the unblocking position.

FIG. 15 shows the G-mass or inertia locking device and pushbutton or release button in the block-out position. The geometry of the G-mass block-out feature relative to the G-mass pivot has a positive cam-out. This feature allows the allow the parts to unlatch after an acceleration event is complete and the occupant wants to unlatch the buckle. The positive cam-out dimension is shown below by dimension 'A'=0.6 mm. Of course and depending on application requirements and designs of the inertia locking device and the cam surfaces dimension 'A' may be greater or less than 0.6 mm.

Dimension 'A' is positioned on the top side of the pivot because as a force is applied to the pushbutton the resulting force on the G-mass causes a rotational torque about the G-mass pivot and therefore will allow the G-mass to rotate up the cam surface or guidance ramp and unlatch the buckle.

In accordance with exemplary embodiments of the present invention the inertia locking device 170 provides a blockout of release button 160 and lock bar 156; the inertia locking device is immune to accelerations in Z axis since the inertia locking device center of gravity 121 is positioned in line with axis of rotation 123 of the inertia locking device with respect to the frame portion of the seat belt buckle. Moreover, the inertia locking device is immune to accelerations in Y axis since the inertia locking device is rotatably mounted to the frame portion by having "D" shaped mounting members 141 rotatably received within complimentary openings 143 in the side walls of the frame portion. The inertia locking device and the release button also has a positive camout for failsafe condition during non-acceleration events wherein the inertia locking device will rotate into an unblocking position with respect to the frame portion.

Referring now to FIG. 8 an exploded view of the seat belt buckle 110 is illustrated, here seat belt buckle 110 comprises a frame portion 128 with a pair of sidewalls 130, which are configured to rotatably receive mounting members 141 of the inertia locking device in openings 143 of the side walls of the frame portion. Referring now to FIGS. 7-14 one alternative non-limiting exemplary embodiment of the present invention is illustrated. As discussed above the inertia locking device 170 has a contact surface 127 configured to contact a cam surface 125' of the release button when the inertia locking device is in a blocking position. In accordance with an exemplary embodiment the cam surface 125' of the release button is provided by a pair of ribs or walls 125 integrally formed with release button. In accordance with an exemplary embodiment the release button is formed from an easily molded material such as plastic wherein all of the features (e.g., biasing member and ribs with the cam surfaces are integrally molded with the release button). Of course, and in alternative exemplary embodiments, the biasing member and cam surfaces may be subsequently attached to the release button. In accordance with an exemplary embodiment the inertia locking device has a pair of slots or open channels 145 configured to allows the walls or ribs 125 to slid therethrough when the release button is in the unblocking position (See at least FIG. 12 and the dashed lines in FIG. 9).

Also illustrated is biasing member 176, which is also integrally formed with the release button. Here the biasing member has an elongated portion 147 with an end portion 149 configured to make contact with the inertia locking device to provide a rotational biasing force in the direction of 131 which causes rotation of the inertia locking device in the direction of arrow thus a contact surface 127 of the inertia locking device is rotated up and away from the cam surfaces 125' of the release button. In accordance with one exemplary embodiment the contact surface 127 of the inertia locking device is positioned above the channels 145 in the inertia locking device (See FIG. 12).

In accordance with an exemplary embodiment and in order to provide an upper limit and lower limit of rotation of the inertia locking device with respect to the frame portion such that over rotation of the inertia locking device is prevented each end of the inertia locking device has a cavity or area 151 configured to receive a protrusion or stud 153 of the side walls 130 in the cavity or area 151. Accordingly, wall portions of the cavity contact the protrusion or stud 153 of the frame portion to provide a stop of limit of rotation of the inertia locking device with respect to the frame portion. See also FIGS. 22A and 22B, wherein the limits of rotation of the inertia locking device are provided when the protrusion 153 contacts a wall of the receiving area or cavity 151 as the inertia locking device rotates in the direction of arrows 150 as the inertia locking device rotates between the blocking position and the unblocking position.

In accordance with an exemplary embodiment the cavities 151 and the protrusions 153 keep the inertia locking device from rotating too far from the blocking position and the unblocking position so that the inertia locking device can rotate from either the blocking position to the unblocking position or from the unblocking position to the blocking position. In accordance with an exemplary embodiment the cavities 151 are disposed at either end of the inertia locking device in a facing spaced relationship with respect to the side walls such that rotation of the inertia locking device is allowed until the cavity wall contacts the protrusion 153. In accordance with an exemplary embodiment it is understood that the blocking position and the unblocking position of the inertia locking device is within the range of rotation limited by the protrusions 153 and cavity 151.

The inertia locking device also has an angled surface 155 disposed within a slot 161 on an upper surface of the inertia locking device. In accordance with an exemplary embodiment of the present invention the end portion 149 contacts the angled surface as the release button translates between the first position and the second position. In accordance with an exemplary embodiment and referring now to FIG. 11 the angled surface 155 rises upward to the upper right hand corner of FIG. 11. Thus, and as the release button 160 is moved in the direction of arrow 157 the end portion 149 contacts the angled surface 155 and the inertia locking device is rotated in the direction of arrow 139 since the angled surface 155 makes contact with end portion 149 and a biasing force is applied in the direction of arrow 131. Accordingly, the inertia locking device is rotated from the blocking position to the unblocking position and the contact surface 127 translates away from the cam surface 125' and the rib or wall 125 slides within a channel 145 so the release button can slide from the first position to the second position in order to unlatch the tongue from the buckle. It being understood that this operation is when the release button is translated from the first position to the second position and there is no acceleration forces being applied to the seat belt buckle.

Figure 13A:
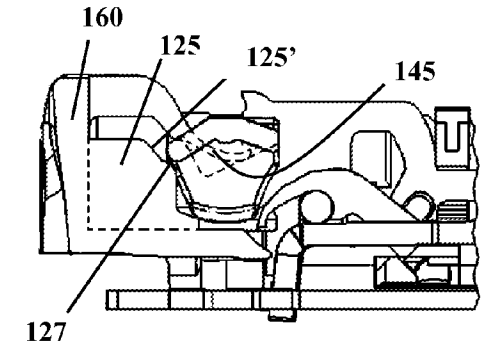
Figure 13B:
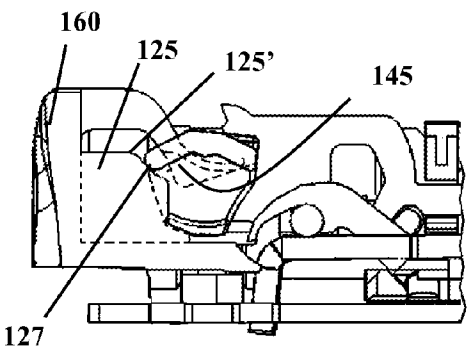
Figure 13C:
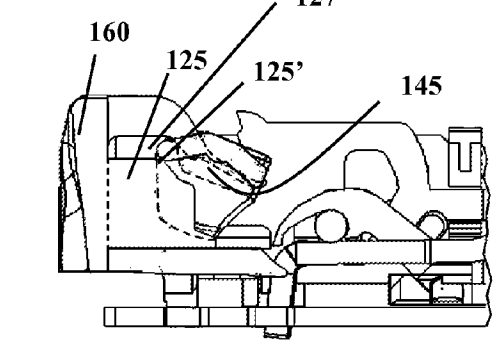
Figure 13D:
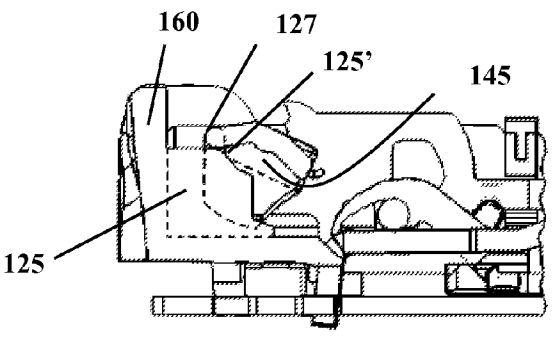
Figure 13E:
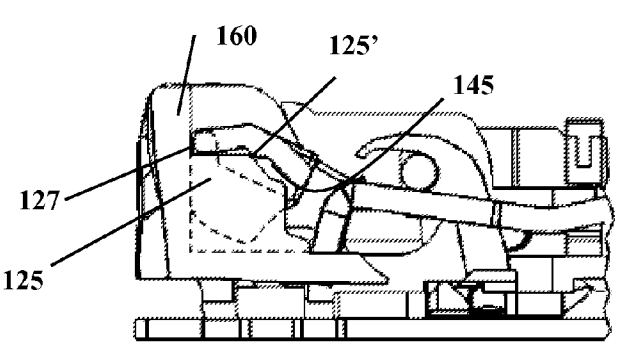

Referring now to FIGS. 13A-13E operation of the seat belt buckle 110 in accordance with exemplary embodiments of the present invention is illustrated. FIGS. 13A-13E illustrate normal operation of the seat belt buckle 110 wherein the release button is slid from a first position to second position and the biasing member rotates the inertia locking device from the blocking position (FIGS. 13A-13B) to the unblocking position (FIGS. 13C-13E). As understood herein the normal operation of the seat belt buckle illustrated in FIGS. 13A-13E is when no inertia forces are being applied to the seat belt buckle by a seat belt/buckle pre-tensioner or seat belt retractor and the release button is translated from the first position to the second position.

FIG. 13A illustrates the latched seat belt buckle and the release button in the first position while FIG. 13B illustrates the latched seat belt buckle and the release button translated approximately 1.0 millimeters (mm) from the first position in the direction of arrow 159 and FIG. 13C illustrates the latched seat belt buckle and the release button translated approximately 2.0 mm from the first position in the direction of arrow 159 and FIG. 13D illustrates the latched seat belt buckle and the release button translated approximately 3.0 mm from the first position in the direction of arrow 159. FIG. 13E illustrates the seat belt buckle in an unlatched position wherein the latch 132 is rotated or pivoted into an unlatched position when a portion of the latch is no longer engaged into an opening of a tongue inserted into the buckle and the release button is translated 6.5 mm from the first position in the direction of arrow 159. Of course, the aforementioned distances of the relative movement of the release button and the inertia locking device are provided as non-limiting examples and the distances and/or movement of the component devices of the seat belt buckle may vary as application configurations require.

FIGS. 14-14A illustrates the center of gravity of the inertia locking device and the pivot axis of the inertia locking device with respect to the frame portion. In accordance with an exemplary embodiment the biasing member 176 provides a biasing force to rotate the inertia locking device in the direction of arrow 139 and the force required to rotate the inertia locking device in a direction opposite to that of arrow 139. In order to rotate the inertia locking device in the direction opposite of arrow 139 the moment acting on the release button or pushbutton and lock bar must be less than the moment rotating the inertia locking device in a direction opposite to arrow 139 such that the contact surface 127 is in a blocking position with respect to cam surface 125'

In accordance with an exemplary embodiment, the inertia locking device blockout theory is explained as follows, wherein:

$F_{f1}$=Frictional Force Pushbutton $F_{f2}$=Frictional Force G-mass pivot $F_{gmass}$=Force of G-mass $F_{pb}+lb$=Force Pushbutton+Lock Bar $R_{pb}+lb+rm$=Reaction Force of the Push Button+Lock Bar+Rotating Mass $\Sigma M_a=0=-M_1-M_2-M_3+M_4$ $M_4$(M pushbutton+lock bar)<$M_1$(M f1 pushbutton)+$M_2$ (Mgmass or inertia locking device )+$M_3$(M gmass pivot). In accordance with an exemplary embodiment $M_4<M_1+M_2+M_3$ thus, the mass or inertia locking device will rotate into the blocking position.

Accordingly, and as shown in the above example, the inertia forces will rotate the mass in a direction opposite to arrow 139 and into the blockout position illustrated in FIG. 14, when $M_1+M_2+M_3$ is greater than $M_4$. As such, exemplary embodiments are configured so that the sensitivity of the mass to accelerations in the X-direction (FIG. 7) are significant enough to overcome rotation the biasing force of the biasing member 176 and $M_1+M_2+M_3$ is greater than $M_4$ thus the inertia locking device is maintained in the blocking position in order to prevent the lock bar and release button are translated into the unlatching position.

Referring now to FIGS. 16-21 another alternative exemplary embodiment of the present invention is illustrated. Here the inertia locking device is provided with an angled surface 155 as shown in FIG. 20. In accordance with an exemplary embodiment the angled surface 155 is provided with a protrusion or feature 171 that maintains an end portion 149 in a facing spaced relationship with the angled surface such that the end portion is prevented from becoming adhered to the angled surface due to dirt, grim and other contaminants (e.g., soda) that may have been spilled into the seat belt buckle. Feature 171 and angled surface 155 are still configured such that translation of the release button from the first position to the second position during normal operation will translate the inertia locking device from the blocking position to the unblocking position when the seat belt buckle is not subject to acceleration forces.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A seat belt buckle, comprising:

a frame portion;

a release button slidably mounted to the frame portion for movement between a first position and a second position;

an inertia locking device rotatably mounted to the frame portion for movement between a blocking position and an unblocking position, the inertia locking device being configured to make contact with a cam surface of the release button when the inertia locking device is in the blocking position and slidable movement of the release button with respect to the frame portion is prevented when the inertia locking device is in the blocking position and the inertia locking device contacts the cam surface of the release button; and a biasing member for providing a biasing force for biasing the inertia locking device into the unblocking position, the inertia locking device being rotated into the blocking position when the biasing force of the biasing member is overcome;

wherein a first end of the inertia locking device has a first cavity configured to movably receive a first feature of the frame portion therein and a second end of the inertia locking device has a second cavity configured to movably receive a second feature of the frame portion therein, the first feature and the second feature defining an upper limit and a lower limit of rotation of the inertia locking device with respect to the frame portion by contacting the first cavity and the second cavity.

2. The seat belt buckle as in claim 1, wherein the frame portion has a pair of side walls and the first feature and the second feature are studs protruding away from a side wall of the frame portion.

3. The seat belt buckle as in claim 1, wherein the inertia locking device has a pair of mounting members each being rotatably received within an opening in the frame portion, the pair of mounting members defining a pivot axis of the inertia locking device and a center of gravity of the inertia locking device is aligned with the pivot axis and the biasing member is integrally formed with the release button and the biasing force is applied at a location offset from the pivot axis when the release button is at the second position.

4. The seat belt buckle as in claim 1, wherein the cam surface is a provided by a pair of walls of the release button and the inertia locking device has a pair of slots configured to allow a portion of the pair of walls therein to allow the inertia locking device to rotate into the unblocking position and the inertia locking device has a contact surface disposed above the pair of slots and the contact surface makes contact with the pair of walls when the inertia locking device is in the blocking position.

5. The seat belt buckle as in claim 1, wherein the inertia locking device has an angled surface for making contact with the biasing member such that as the release button is moved from the first position to the second position and the biasing force of the biasing member rotates the inertia locking device into the unblocking position.

6. The seat belt buckle as in claim 5, wherein the angled surface of the inertia locking device is located in a slot of the inertia locking device and the biasing member is integrally formed with the release button.

7. The seat belt buckle as in claim 5, wherein the biasing member is integrally formed with the release button and the angled surface is located in a slot disposed in a surface of the inertia locking device and the angled surface further comprises a protrusion, the protrusion making contact with the biasing member and an end of the biasing member is maintained in a facing spaced relationship with respect to the angled surface.

8. The seat belt buckle as in claim 6, wherein the slot is centrally located on a surface of the inertia locking device.

9. The seat belt buckle as in claim 1, wherein the cam surface of the release button and the contact surface of the inertia locking device are configured to allow the inertia locking device to rotate in the unblocking position.

10. The seat belt buckle as in claim 1, wherein the release button and the biasing member is plastic, the inertia locking device is metal and the frame is metal and the inertia locking device is only sensitive to accelerations in one of three axis through the seat belt buckle.

11. The seat belt buckle as in claim 1, wherein the biasing member is integrally formed with the release button and the biasing member is an elongated member with an end portion configured to contact an angled surface of the inertia locking device.

12. The seat belt buckle as in claim 11, wherein the biasing member rotates the inertia locking device towards the unblocking position when the release button is moved from the first position to the second position and the biasing member rotates the inertia locking device towards the blocking position when the release button is moved from the first position towards the second position.

13. The seat belt buckle as in claim 12, wherein the angled surface is located in a slot disposed in a surface of the inertia locking device and the angled surface further comprises a protrusion, the protrusion making contact with the biasing member and an end of the biasing member is maintained in a facing spaced relationship with respect to the angled surface.

14. A seat belt buckle for use with a tongue of a seat belt, the seat belt buckle comprising:

a frame portion;

a latch being movably mounted to the frame portion for movement between a latched position and an unlatched position, the latch being configured to engage a portion of the tongue inserted into the frame as the latch moves from the latched position to the unlatched position; an ejector being slidably mounted to the frame portion for movement between a locking position and a release position and movement of the ejector towards the release position causes an opening force to be applied to the latch in order to move the latch from the unlatched position towards the latched position and movement of the ejector towards the release position is caused by movement of a release button slidably mounted to the frame portion for movement between a first position and a second position;

an inertia locking device rotatably mounted to the frame portion about a pivot axis for movement between a blocking position and an unblocking position, the inertia locking device being configured for rotation in a plane substantially parallel to a plane of movement of the latch and a center of gravity of the inertia locking device is aligned with the pivot axis of the inertia locking device, the inertia locking device being configured to make contact with a cam surface of the release button when the inertia locking device is in the blocking position and slidable movement of the release button with respect to the frame portion is prevented when the inertia locking device is in the blocking position and the inertia locking device contacts the cam surface of the release button; and a biasing member integrally formed with the release button, the biasing member providing a biasing force for biasing the inertia locking device into the unblocking position, the inertia locking device being rotated into the blocking position when biasing force of the biasing member is overcome;

wherein a first end of the inertia locking device has a first cavity configured to movably receive a first feature of the frame portion therein and a second end of the inertia locking device has a second cavity configured to movably receive a second feature of the frame portion therein, the first feature and the second feature defining an upper limit and a lower limit of rotation of the inertia locking device with respect to the frame portion by contacting the first cavity and the second cavity.

15. The seat belt buckle as in claim 14, wherein the inertia locking device has a pair of mounting members each being rotatably received within an opening in the frame portion, the pair of mounting members defining a pivot axis of the inertia locking device and a center of gravity of the inertia locking device is aligned with the pivot axis and the cam surface is a provided by a pair of walls of the release button and the inertia locking device has a pair of slots configured to allow a portion of the pair of walls therein to allow the inertia locking device to rotate into the unblocking position and the inertia locking device has a contact surface disposed above the pair of slots and the contact surface makes contact with the pair of walls when the inertia locking device is in the blocking position.

16. The seat belt buckle as in claim 14, wherein the biasing member is an elongated member with an end portion configured to contact an angled surface of the inertia locking device and the biasing member rotates the inertia locking device towards the unblocking position when the release button is moved from the first position to the second position and the biasing member rotates the inertia locking device towards the blocking position when the release button is moved from the first position towards the second position.

17. A method for limiting movement of a release button of a seat belt buckle when an acceleration force is applied to the seat belt buckle, the method comprising:

rotatably mounting a mass to a frame portion of the seat belt buckle for movement between a blocking position and an unblocking position, the mass being configured to make contact with a cam surface of the release button when the mass is in the blocking position and slidable movement of the release button with respect to the frame portion is prevented when the mass is in the blocking position and the mass contacts the cam surface of the release button;

biasing the mass into the unblocking position by a biasing member integrally formed with the release button, the biasing member providing a biasing force for biasing the mass into the unblocking position and the inertia locking device is rotated into the blocking position when the biasing force of the biasing member is overcome; and limiting rotation of the mass by locating a feature of the frame portion within a cavity of the mass, the cavity defining a range of rotation of the mass and wherein the biasing member is an elongated member with an end portion configured to contact an angled surface of the mass and the biasing member rotates the mass towards the unblocking position when the release button is moved from a first position to a second position and the biasing member rotates the mass towards the blocking position when the release button is moved from the first position towards the second position.

* * * * *